US007377494B2

(12) United States Patent
French et al.

(10) Patent No.: US 7,377,494 B2
(45) Date of Patent: May 27, 2008

(54) HUMIDIFIER

(75) Inventors: Jon French, Uxbridge, MA (US); Robert A. Barker, Berlin, MA (US); Don Bryce, Framingham, MA (US); Francis E. Marino, Meredith, NH (US); Tsuguji Nakano, West Lebanon, NH (US); Gregory W. Bachmann, Manhasset, NY (US)

(73) Assignee: Sunbeam Products, Inc., Boca Raton, FL (US)

( * ) Notice: Subject to any disclaimer, the term of this patent is extended or adjusted under 35 U.S.C. 154(b) by 0 days.

(21) Appl. No.: 11/391,899

(22) Filed: Mar. 29, 2006

(65) Prior Publication Data

US 2006/0170121 A1 Aug. 3, 2006

Related U.S. Application Data

(62) Division of application No. 10/755,201, filed on Jan. 9, 2004, now Pat. No. 7,073,782.

(51) Int. Cl.
*B01F 3/04* (2006.01)

(52) U.S. Cl. ..... 261/30; 261/107; 261/DIG. 41

(58) Field of Classification Search ..... 261/30, 261/96, 100, 102, 104–107, 109, DIG. 41
See application file for complete search history.

(56) References Cited

U.S. PATENT DOCUMENTS 1,646,329 A 10/1927 Ulrich
1,817,442 A * 8/1931 Martin, Jr. ..... 261/80
1,970,301 A 8/1934 Frankel
1,991,581 A 2/1935 Shelor
2,031,055 A 2/1936 McKinney
2,032,634 A 3/1936 Ross
2,092,630 A 9/1937 Bailey
2,128,462 A 8/1938 Kahn et al.
2,187,019 A 1/1940 DeMund et al.
2,217,130 A * 10/1940 Niehart ..... 96/275
2,322,110 A * 6/1943 Bock ..... 261/24
2,411,041 A 11/1946 Kahn
2,637,540 A 5/1953 Rowe
2,827,270 A 3/1958 Martin
3,044,237 A * 7/1962 Mart ..... 96/356
3,193,261 A 7/1965 Nesbitt
3,215,416 A 11/1965 Liben
3,274,993 A 9/1966 Martin (Continued)

*Primary Examiner*—Scott Bushey
(74) *Attorney, Agent, or Firm*—Hoffmann & Baron, LLP

(57) ABSTRACT

The present invention is a family of portable humidifiers. Each of the portable humidifiers has a housing, a number of wick assemblies, and a fan. The housing has an air inlet, an air outlet and a reservoir for holding water. The number of wick assemblies are positioned within the housing to contact the water in the reservoir. The wick assemblies are arranged in parallel between the air inlet and the fan. The fan is provided within the housing for creating an airflow. The airflow enters the air inlet, passes through the wick assemblies for adding moisture to the airflow from the water in the reservoir, and exits through the air outlet. The number for at least one of the portable humidifiers is different from the number for another of the portable humidifiers. Preferably each of the portable humidifiers includes a wick frame seated within the reservoir for supporting the wick assemblies. Each of the wick assemblies preferably has a wick element and a button.

20 Claims, 35 Drawing Sheets

U.S. PATENT DOCUMENTS 3,284,068 A 11/1966 Goettl
3,348,822 A 10/1967 Vieceli
3,495,381 A 2/1970 Flanagan
3,497,453 A 2/1970 Yurdin
3,645,071 A 2/1972 Gray
3,747,773 A 7/1973 Jackson
3,806,102 A 4/1974 Valenta et al.
3,864,437 A 2/1975 Blaszkowski
3,873,806 A 3/1975 Schossow
3,917,759 A 11/1975 Martin
4,089,915 A 5/1978 Jackson
4,139,762 A 2/1979 Pohrer et al.
4,166,087 A 8/1979 Cline et al.
4,210,278 A 7/1980 Obler
4,217,317 A * 8/1980 Neu ..... 261/160
4,225,542 A 9/1980 Wall et al.
4,251,583 A 2/1981 Donachiue
4,563,313 A 1/1986 Tsuaki
4,604,246 A 8/1986 Choe
4,631,152 A 12/1986 Uchida et al.
4,649,000 A 3/1987 Bisemeyer
4,663,091 A 5/1987 Seo
4,672,820 A 6/1987 Goettl
4,698,188 A 10/1987 Gutmann
4,724,104 A 2/1988 Kim
4,734,561 A 3/1988 Miller
4,752,423 A 6/1988 Wong
4,839,014 A 6/1989 Park et al.
5,014,338 A 5/1991 Glucksman
5,037,583 A 8/1991 Hand
5,037,586 A 8/1991 Mehrholz et al.
5,061,405 A 10/1991 Stanek et al.
5,143,655 A 9/1992 Chiu et al.
5,210,818 A 5/1993 Wang
5,242,375 A 9/1993 McDonough
5,286,942 A 2/1994 McFadden et al.
5,313,550 A 5/1994 Grosnier et al.
5,339,383 A 8/1994 Marino
5,343,551 A 8/1994 Glucksman
5,354,515 A 10/1994 Ushimaru
5,374,381 A 12/1994 Schuld et al.
5,407,604 A 4/1995 Luffman
5,447,663 A 9/1995 Dix et al.
5,480,588 A 1/1996 Tomasiak et al.
5,483,616 A 1/1996 Chiu et al.
5,524,848 A 6/1996 Ellsworth
5,529,726 A 6/1996 Glenn
5,540,867 A 7/1996 DeBello
5,688,446 A 11/1997 Glenn
5,695,117 A 12/1997 Sizemore et al.
5,783,117 A 7/1998 Byassee et al.
5,792,390 A 8/1998 Marino
5,800,741 A 9/1998 Glenn et al.
5,851,441 A * 12/1998 Kato et al. ..... 261/26
5,943,473 A 8/1999 Levine
5,945,038 A 8/1999 Anderson
5,971,205 A 10/1999 Michaels et al.
5,971,370 A 10/1999 Galabinski
5,975,502 A 11/1999 Stanek et al.
6,052,511 A 4/2000 Birdsell
6,053,482 A 4/2000 Glenn et al.
6,149,141 A 11/2000 Birdsell
6,168,140 B1 1/2001 Akazawa
6,237,899 B1 5/2001 Offir et al.
6,275,652 B1 8/2001 Chauviaux
6,308,939 B2 10/2001 Offir et al.
6,335,517 B1 1/2002 Chauviaux et al.
6,416,043 B1 7/2002 Eisenbraun
6,523,810 B2 2/2003 Offir et al.
6,568,662 B2 5/2003 Schuld
6,610,118 B2 8/2003 Bryce et al.
6,796,550 B2 * 9/2004 Mulvaney ..... 261/26
2002/0195728 A1 12/2002 Wooderson

* cited by examiner

HUMIDIFIER

CROSS-REFERENCE TO RELATED U.S. APPLICATIONS

This application is a divisional application of U.S. Application Ser. No. 10/755,201, filed on Jan. 9, 2004, now U.S. Pat. No. 7,073,782.

BACKGROUND OF THE INVENTION

1. Field of the Invention

The present invention relates to an evaporative humidifier having a wick assembly. More particularly, the present invention relates to a wick assembly that includes a wick element and a rivet.

2. Description of the Prior Art

Humidifiers are useful in raising the humidity of air inside homes, particularly during periods of dry weather during the winter and heat inside a home causes the relative humidity within the home to be lowered to an uncomfortable level. Under these circumstances, it is beneficial to introduce moisture into the air. Several types of humidifiers for increasing humidity in a room are well known in the art, and include steam-type, ultrasonic, warm-air and evaporative humidifiers.

Certain humidifiers, and in particular the evaporative type, generally include a housing having an inlet, an outlet, and a reservoir for holding water, a water absorbing material seated partially submerged in the water of the reservoir, and a fan that is connected to the housing for creating an airflow. The water absorbing material is generally known as a wick in the art and is adapted to draw water in the upper non-immersed part by capillary action. The airflow created by the fan is directed to pass through the upper non-immersed portion of the wick to humidify the air in the room. The wicks tend to accumulate minerals from the water which blocks the capillary action of the wick. Accordingly, the performance of the wick degrades over time requiring replacement of the wick.

Portable humidifiers are currently manufactured with different performance capacities to suit a consumer's particular needs. The retailers that carry humidifiers are generally required out of necessity to offer a line of humidifiers having different performance characteristics. Since humidifiers that have a higher performance capacity generally require a larger wick, retailers must stock a plurality of different size wicks to satisfy the demands of all consumers. Replacement wicks are traditionally a bulky and expensive inventory for retailers to maintain because the wicks are expensive to purchase, do not turn over very often, and take up a lot of shelf space. In addition, the problem is exacerbated by the fact that very often by the time the consumer needs to replace the wick element, the packaging on the wick looks old and shoddy.

Another general problem associated with humidifiers is that the devices create noise which can be disturbing to the user. Most of the noise attributed to the humidifier is attributed to the airflow through the device. Generally the noise levels generated by the humidifier will increase with the volume of airflow passing through the device.

OBJECTS AND SUMMARY OF THE INVENTION

It is an object of the present invention to provide a humidifier with a wick assembly that includes a wick element and a rivet.

It is another object of the present invention to provide a humidifier with a wick frame for supporting a plurality of wick assemblies.

It is another object of the present invention to provide a humidifier with improved performance characteristics.

It is another object of the present invention to provide a family of humidifiers that utilize one or more of the same wick assemblies.

A family of portable humidifiers is presented in accordance with the present invention. The family includes a plurality of portable humidifiers. Each of the plurality of portable humidifiers has a housing, a number of wick assemblies, and a fan. The housing has an air inlet, an air outlet and a reservoir for holding water. The wick assemblies are positioned within the housing to contact the water in the reservoir. The wick assemblies are arranged in parallel between the air inlet and the fan. The fan is provided within the housing for creating an airflow. The airflow enters the air inlet, passes through the wick assemblies for adding moisture to the airflow from the water in the reservoir, and exits through the air outlet. The number for at least one of the plurality of portable humidifiers is different from the number for another of the plurality of portable humidifiers. Preferably each of the plurality of portable humidifiers further comprises a wick frame seated within the reservoir for supporting the wick assemblies. Each of the wick assemblies preferably includes a wick element and a button.

In a preferred embodiment of the present invention, a portable humidifier includes a housing, at least two wick assemblies, and a fan. The housing includes an air inlet, an air outlet and a reservoir for holding water. The wick assemblies are positioned within the housing to contact the water in the reservoir and are arranged in parallel between the air inlet and the fan. The fan is provided within the housing for creating an airflow. The airflow enters the air inlet, passes through the wick assemblies for adding moisture to the airflow from the water in the reservoir, and exits through the air outlet. The portable humidifier preferably has a wick frame seated within the reservoir for supporting the wick assemblies. Each of the wick assemblies preferably has a wick element and a button.

In another embodiment of the present invention, a portable humidifier includes a housing, a wick unit, and a fan. The housing includes an air inlet, an air outlet, a contraction zone and a reservoir for holding water. The wick unit is positioned within the housing to contact the water in the reservoir. The fan has a propeller provided within the housing for creating an airflow having a mean velocity. The propeller is located within the contraction zone. The airflow enters the air inlet, passes through the wick unit for adding moisture to the airflow from the water in the reservoir, passes through the contraction zone for increasing the mean velocity of the airflow and exits through the air outlet.

In a preferred embodiment, the contraction zone includes an entrance and an exit. The entrance has a first-air-flow area to accommodate the airflow, and the exit has a second-air-flow area to accommodate the airflow. The first-air-flow area is preferably larger than the second-air-flow area. The first-air-flow area and the second-air-flow area are preferably defined by an inner perimeter and an outer perimeter. The outer perimeter at the entrance is preferably larger than the outer perimeter at the exit. The inner perimeter at the entrance is preferably smaller than the inner perimeter at the exit. The portable humidifier preferably includes a tapered sleeve located between the entrance and the exit of the contraction zone. The tapered sleeve has an inner surface which defines the outer perimeter. The portable humidifier preferably includes a hub located between the entrance and the exit of the contraction zone. The hub preferably includes a substantially conical frustum shaped side surface which defines the inner perimeter. The propeller preferably includes the hub and at least one fan blade.

In another preferred embodiment, the portable humidifier preferably includes a diffusion zone located between the contraction zone and the air outlet. The diffusion zone reduces the mean velocity of the airflow. Preferably the diffusion zone includes a first end and a second end. The first end has a third-air-flow area to accommodate the airflow, and the second end has a fourth-air-flow area to accommodate the airflow. The third-air-flow area is preferably smaller than the fourth-air-flow area. The third-air-flow area and the fourth-air-flow area are preferably defined by a second inner perimeter and a second outer perimeter. The second outer perimeter at the first end is preferably smaller than the second outer perimeter at the second end. The second inner perimeter at the first end is preferably substantially equal to the second inner perimeter at the second end. The portable humidifier preferably includes a second tapered sleeve located between the first end and the second end of the diffusion zone. The second tapered sleeve preferably has a second inner surface which defines the second outer perimeter. The portable humidifier preferably includes a tube located between the first end and the second end of the diffusion zone. The tube has a substantially cylindrical shaped side surface which defines the second inner perimeter. The air outlet is preferably formed as a grill at the second end of the diffusion zone, and the tube is connected to the grill.

In another embodiment of the present invention, a wick unit for placement within a reservoir of a portable humidifier includes at least two wick assemblies and a wick frame. Each of the wick assemblies includes a wick element and a button which is attached to the wick element. The wick frame supports the wick assemblies to contact water located within the reservoir. The wick frame has walls formed to define a plurality of spaces. Each of the plurality of spaces is configured to receive one of the wick assemblies. The wick frame also includes at least one slot for each of the plurality of spaces for cooperating with the button. The wick element preferably has a substantially uniform thickness and a rectangular shape. The wick frame preferably has a substantially circular perimeter. Each of the plurality of spaces is preferably configured to have a circular segmented cross section. The button is preferably configured to bias the wick element against the walls of the wick frame to conform the rectangular shape of the wick element to the circular segmented cross section. The wick element is preferably formed from a cellulose or cotton material.

In yet another embodiment of a present invention, a wick assembly for removable mounting within a portable humidifier includes a wick element and a button attached to the wick element. The button attaches the wick assembly to the portable humidifier. The wick element is preferably defined by a surface such that the button extends from the surface. The wick element preferably has a substantially uniform thickness and a shape. The shape of the wick element is preferably rectangular. The button is preferably formed as part of a rivet. The rivet preferably includes a rod, a first retaining plate, a second retaining plate, and the button. The rod is defined as having a first end and a second end with the button being connected to the first end. The first retaining plate is connected between the first end and the second end to define a first portion and a second portion. The first portion of the rod is located between the first end and the first retaining plate. The second portion of the rod is located between the first retaining plate and the second end. The second retaining plate is connected at the second end of the rod. The second portion of the rod is configured to extend through the wick element so that the wick element is located between the first retaining plate and the second retaining plate. The second retaining plate is preferably formed with an opening receiving the second end of the rod and the second end of the rod is preferably formed with a lip for engaging the second retaining plate. The cross section of the rod and the opening is preferably circular. The second retaining plate is preferably located on the second portion of the rod between the lip and the wick element. The wick element is preferably formed from a cellulose or cotton material.

DETAILED DESCRIPTION OF THE PREFERRED EMBODIMENTS

Figure 1:
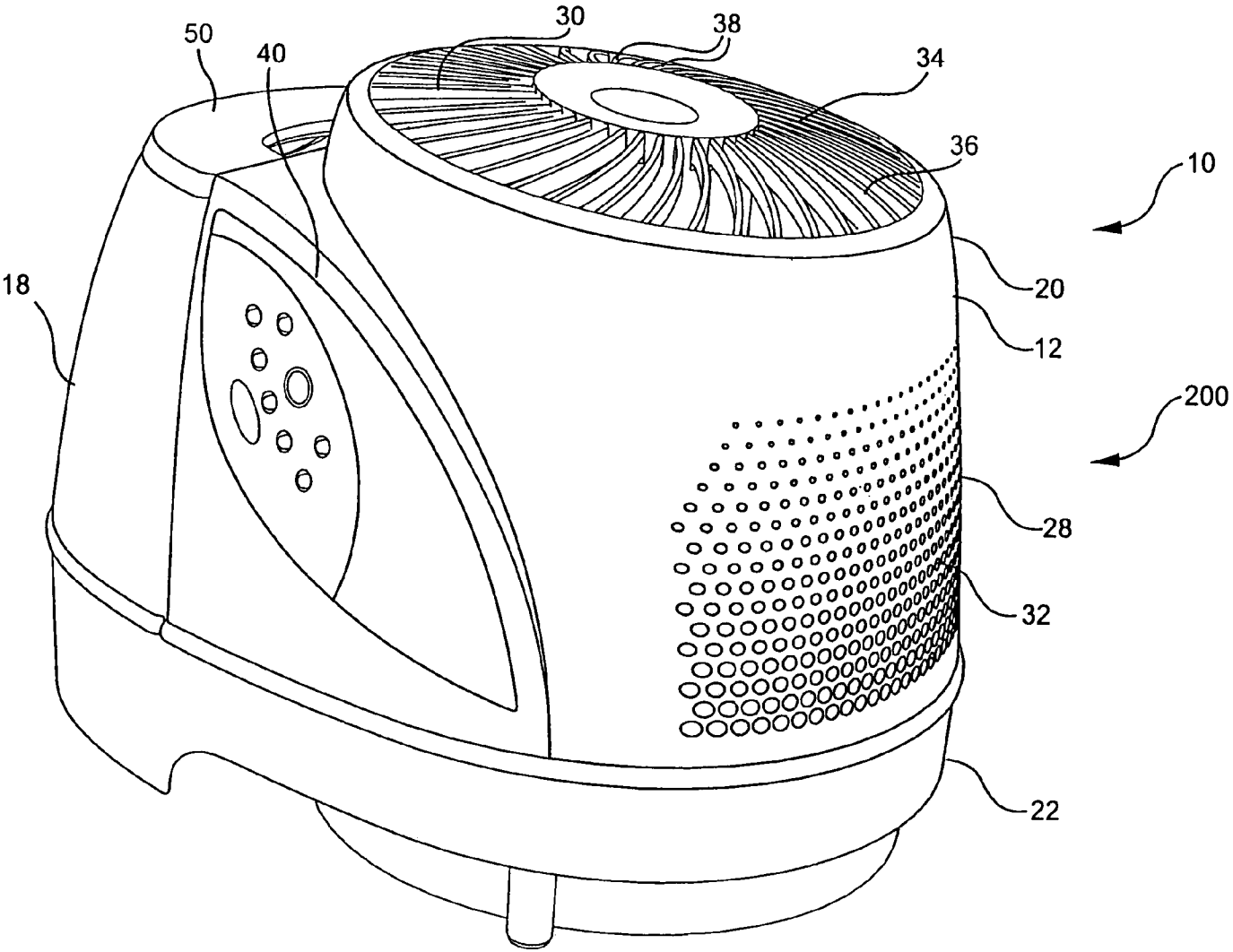
FIG. 1 is a front perspective view of a first member of a family of humidifiers in accordance with the present invention.
Figure 5:
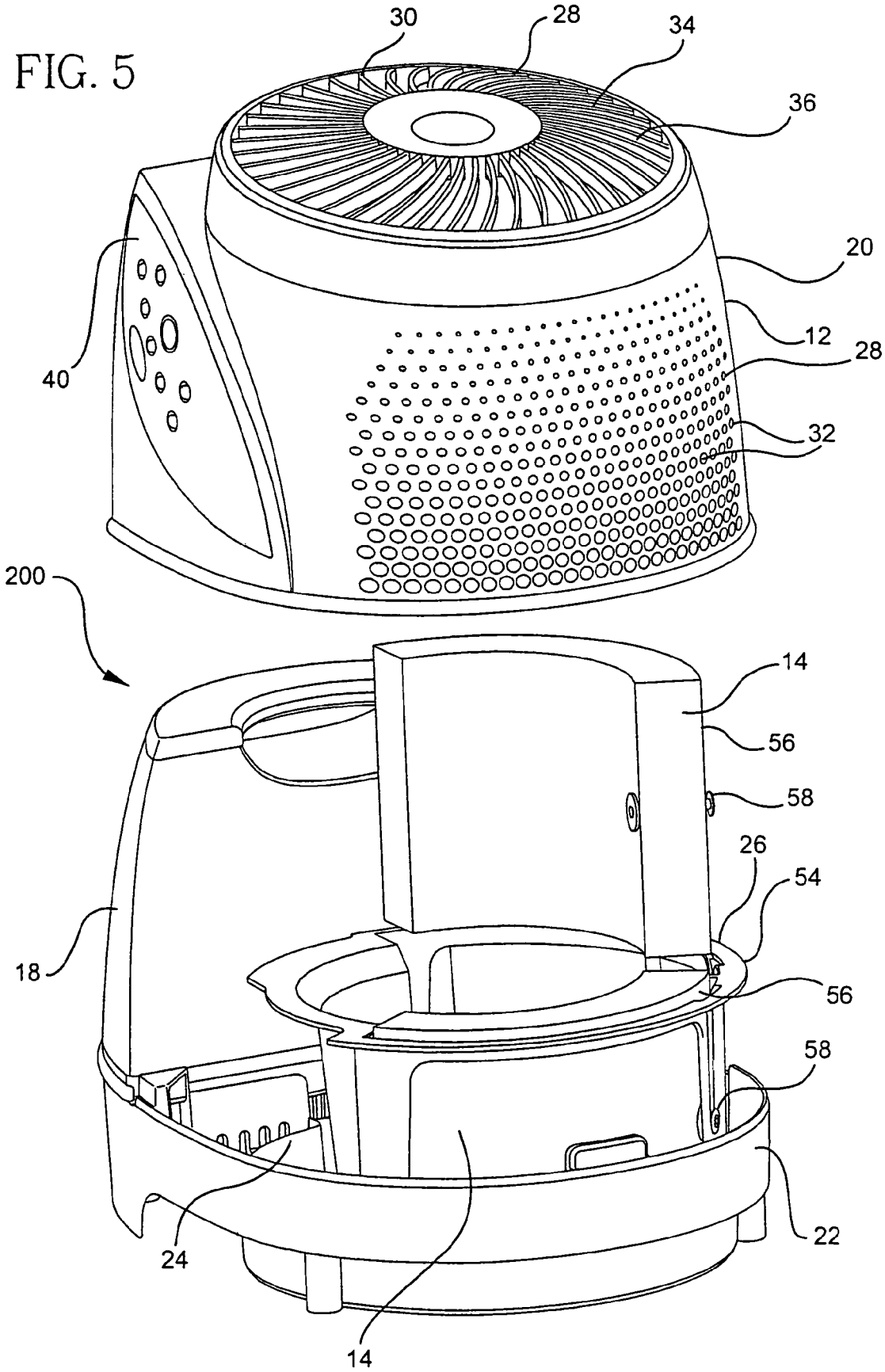
FIG. 5 is a partially exploded perspective view of the humidifier shown in FIG. 1
Figure 6:
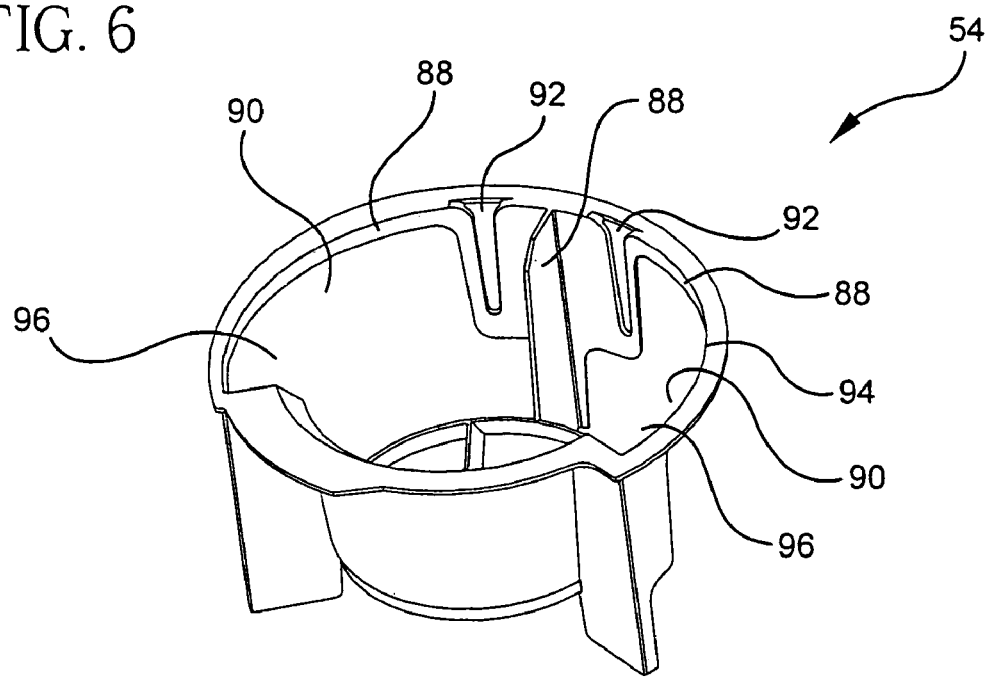
FIG. 6 is a perspective view of the wick frame for the first member of the family of humidifiers.
Figure 8:
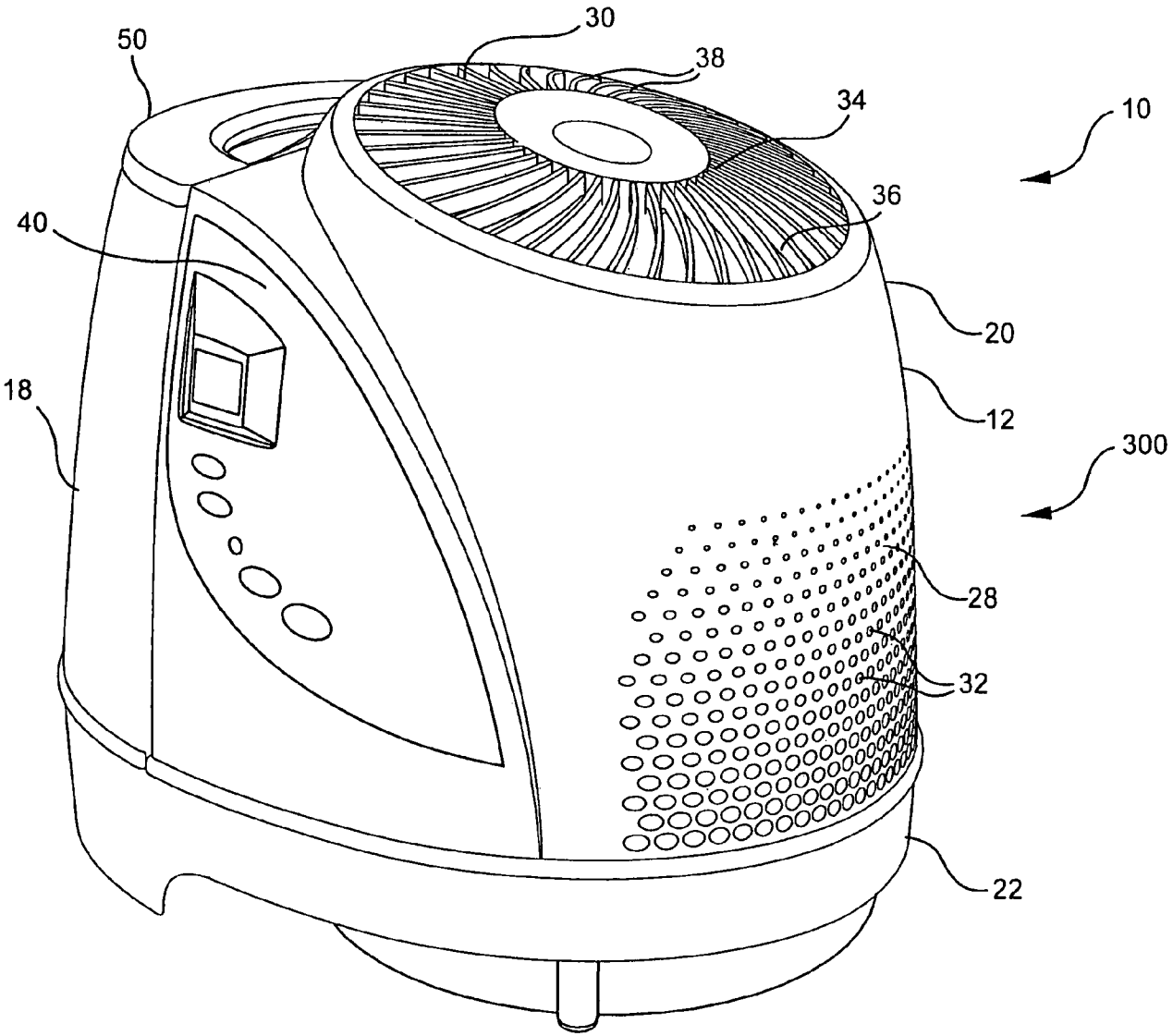
FIG. 8 is a front perspective view of a second member of a family of humidifiers in accordance with the present invention.
Figure 12:
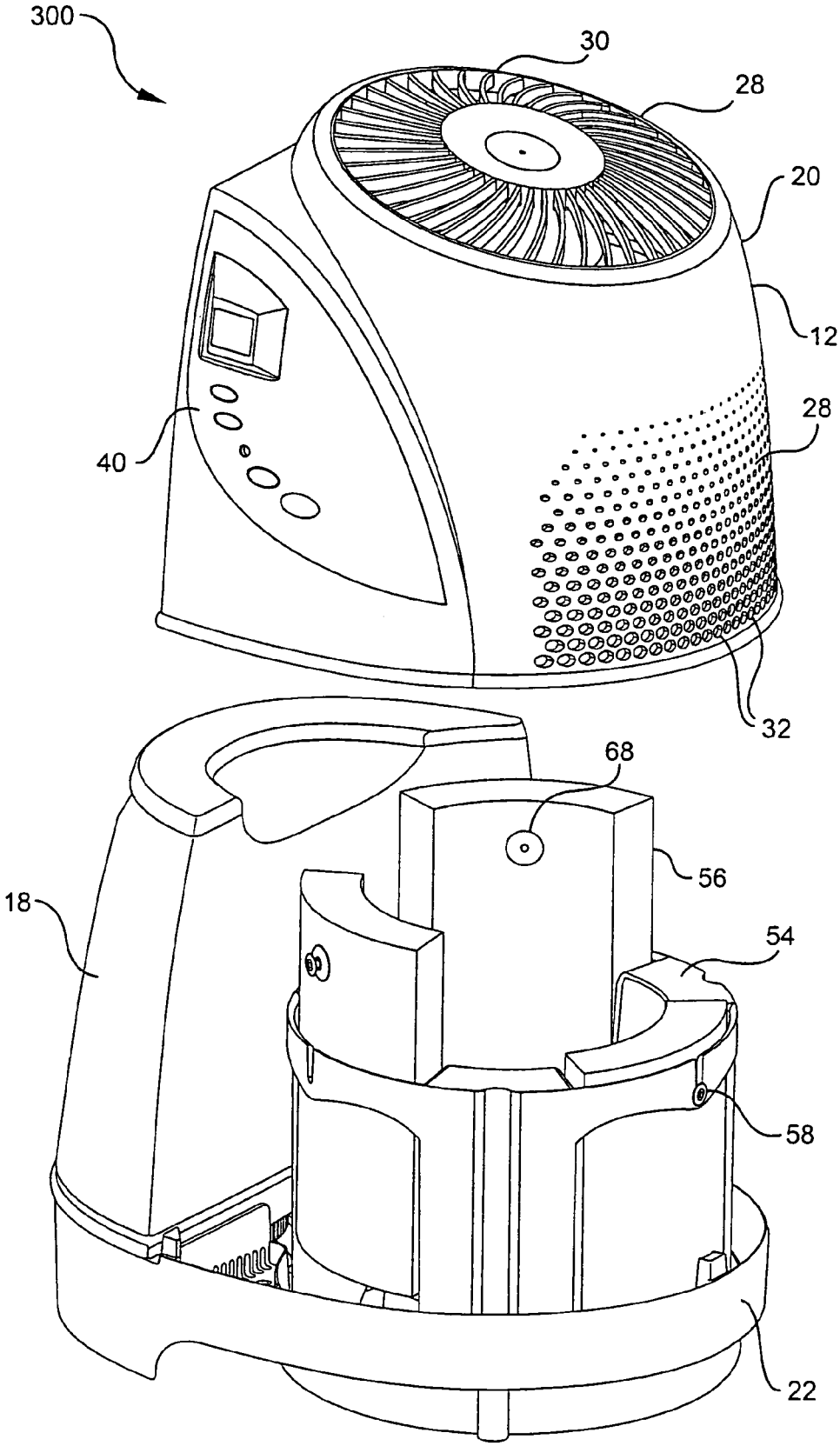
FIG. 12 is a partially exploded perspective view of the humidifier shown in FIG. 8.
Figure 13:
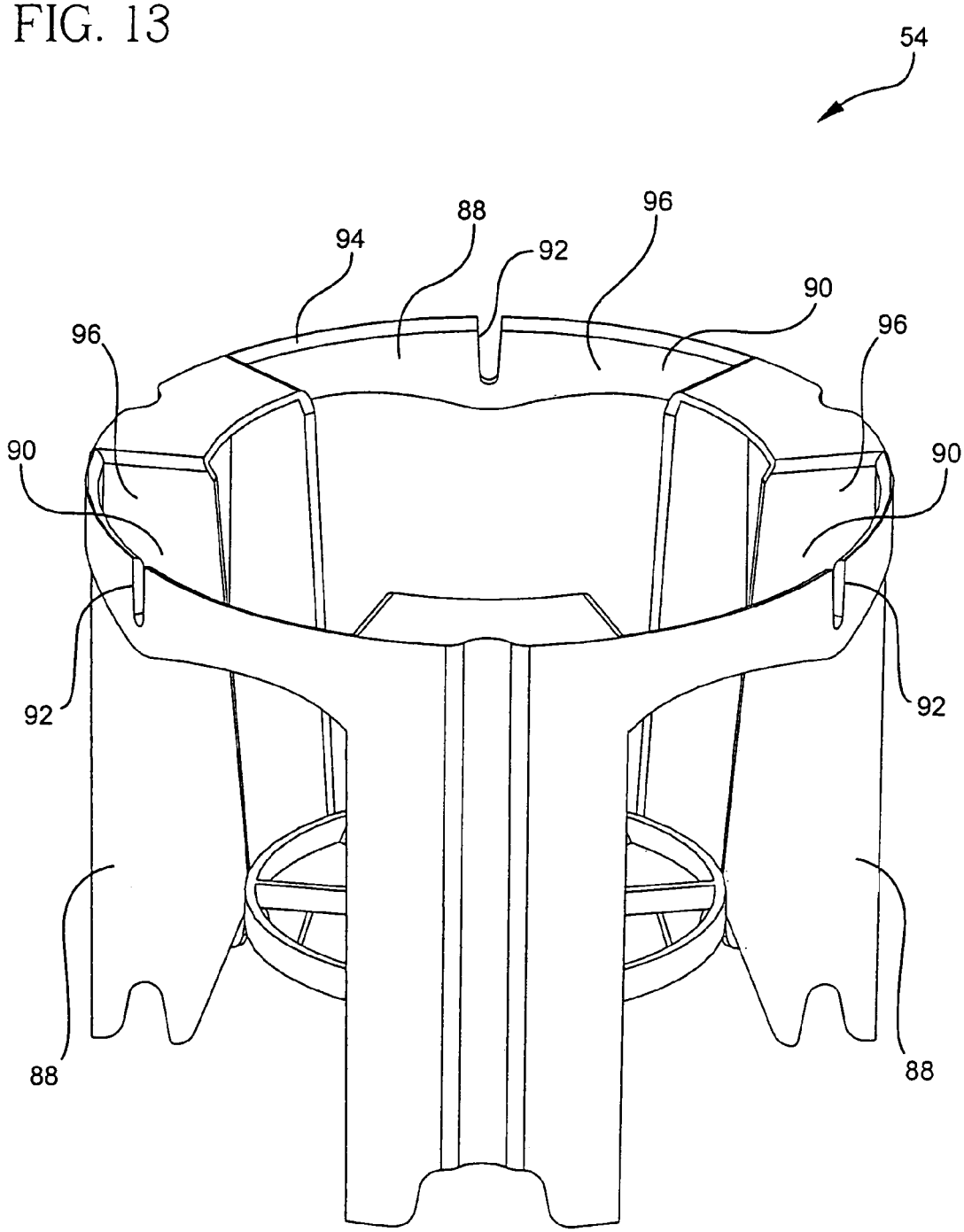
FIG. 13 is a perspective view of the wick frame for the second member of the family of humidifiers.
Figure 16:
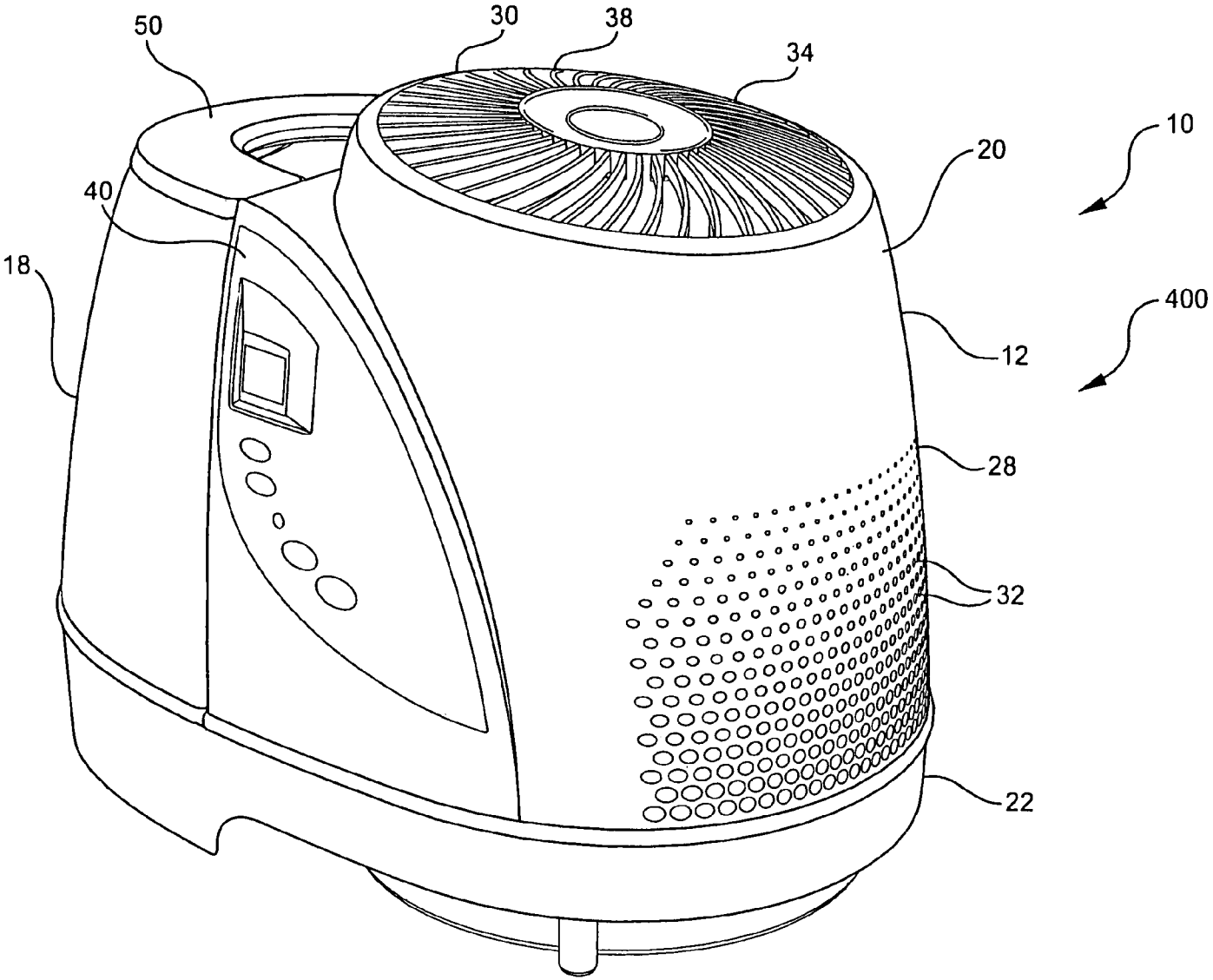
FIG. 16 is a front perspective view of a third member of a family of humidifiers in accordance with the present invention.
Figure 22:
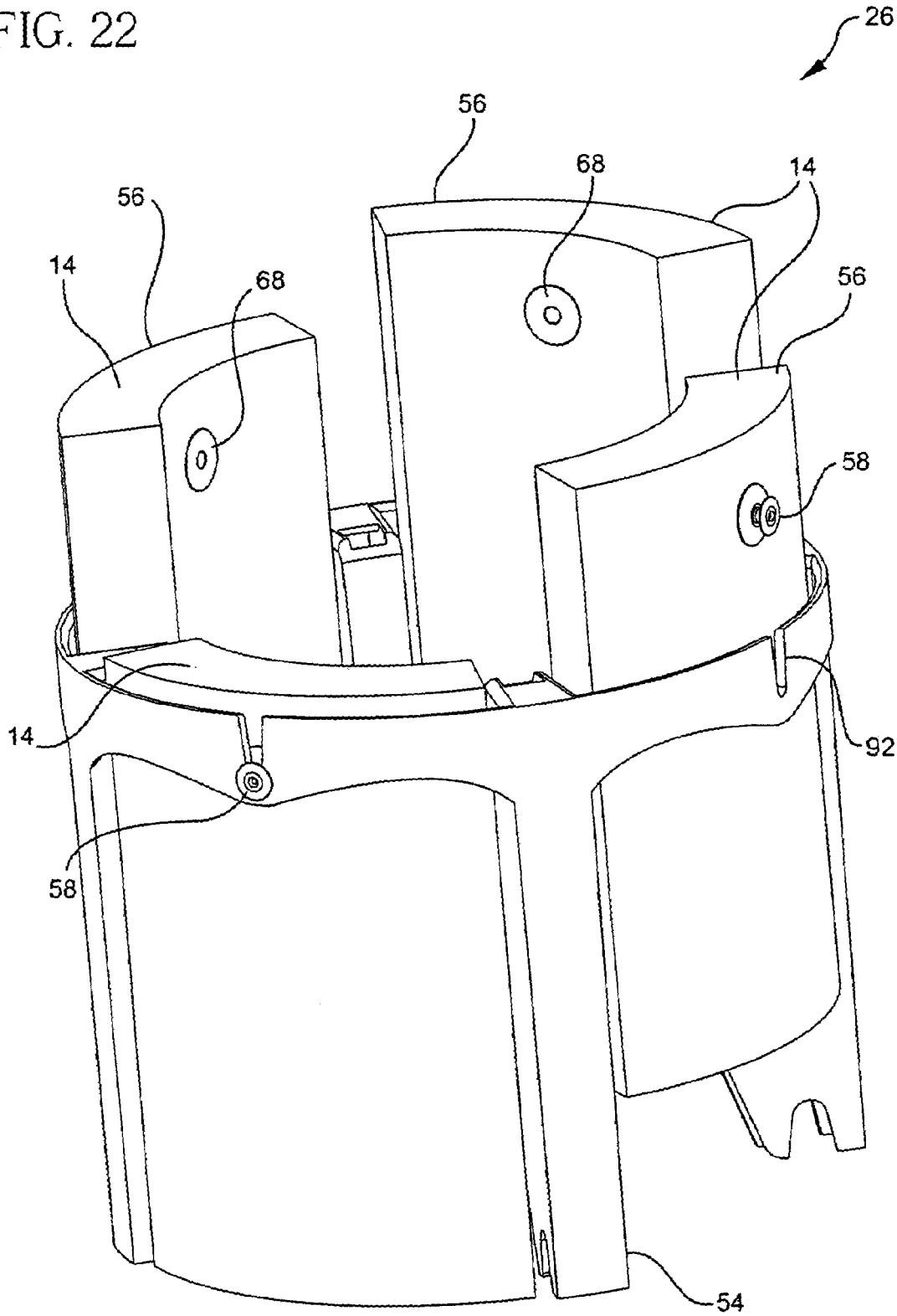
FIG. 22 is a partially exploded perspective view of the wick frame shown in FIG. 20 with the wick assemblies.

Initially referring to FIGS. 1, 8, and 16, the present invention is directed to a family of portable humidifiers 10. The family 10 includes a plurality of portable humidifiers 200, 300, 400. Each of the plurality of portable humidifiers 200, 300, 400 has a housing 12, a number of wick assemblies 14, and a fan 16. The number for at least one of the plurality of portable humidifiers 200, 300, 400 is different from the number for another of the plurality of portable humidifiers 200, 300, 400. The number is also preferably at least two to ensure that the portable humidifier includes at least two wick assemblies 14. Referring to FIGS. 5, 12 and 22, the plurality of portable humidifiers 200, 300, 400 each respectively include 2, 3, and 4 wick assemblies 14. Although not shown, one skilled in the art would understand that a humidifier can be configured to use only one wick assembly 14 in accordance with the present invention. Each of the plurality of portable humidifiers 200, 300, 400 also preferably includes a water tank assembly 18. The description of the family of portable humidifiers 10 below uses the same reference characters for each portable humidifier 200, 300, 400 to the extent that the same element is being described.

Figure 2:
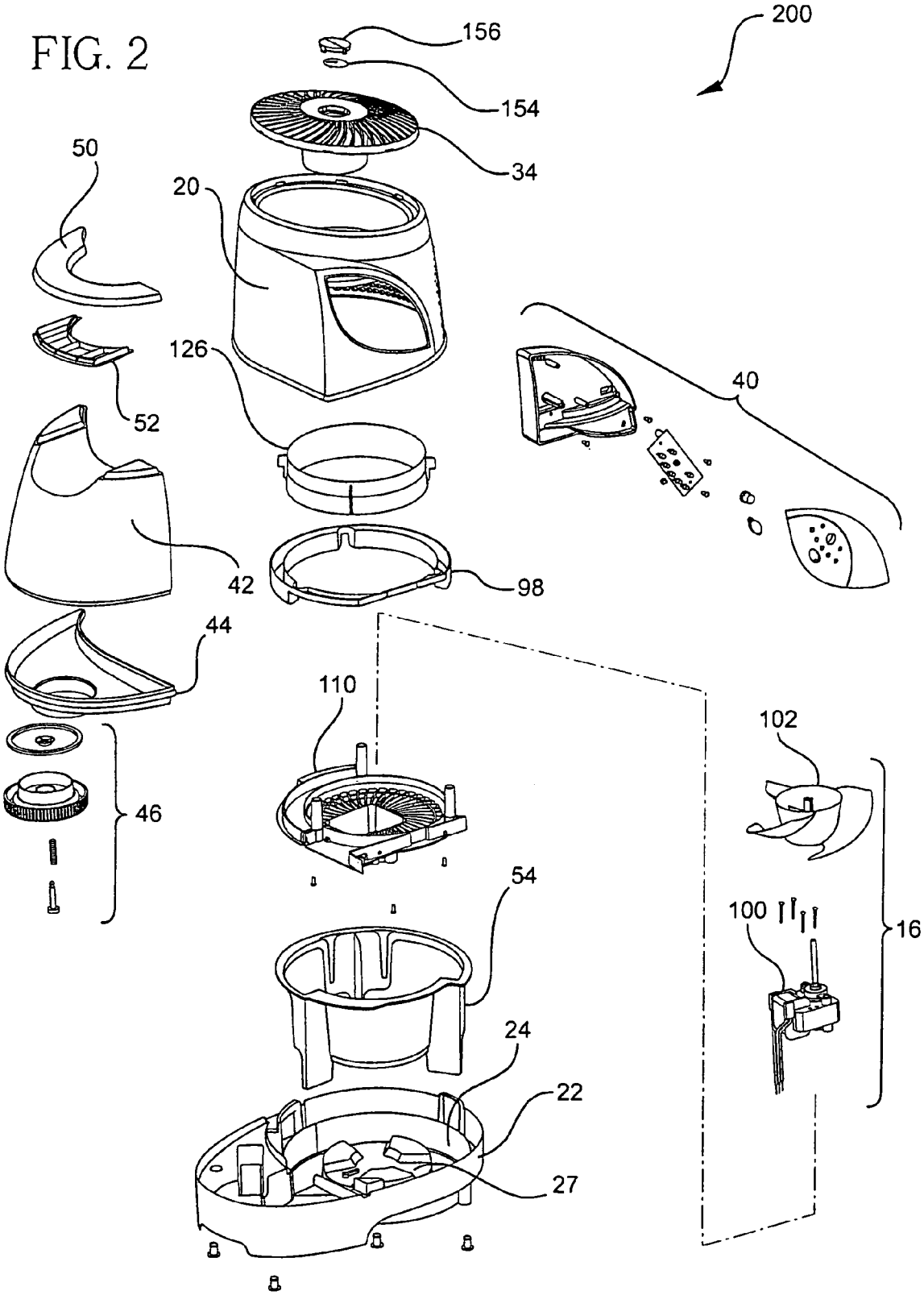
FIG. 2 is an exploded perspective view of the humidifier shown in FIG. 1.
Figure 3:
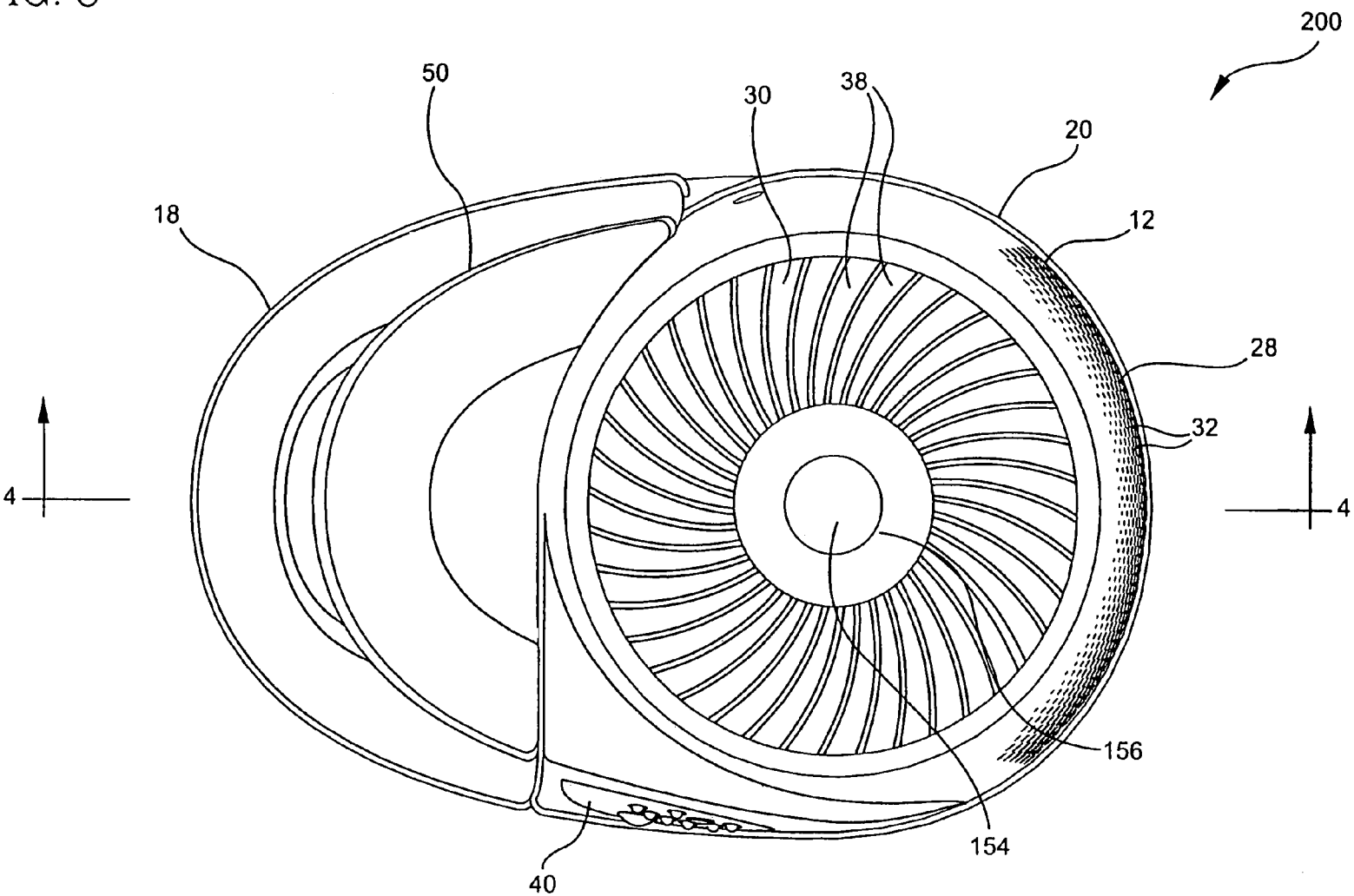
FIG. 3 is a top plan view of the humidifier shown in FIG. 1.
Figure 4:
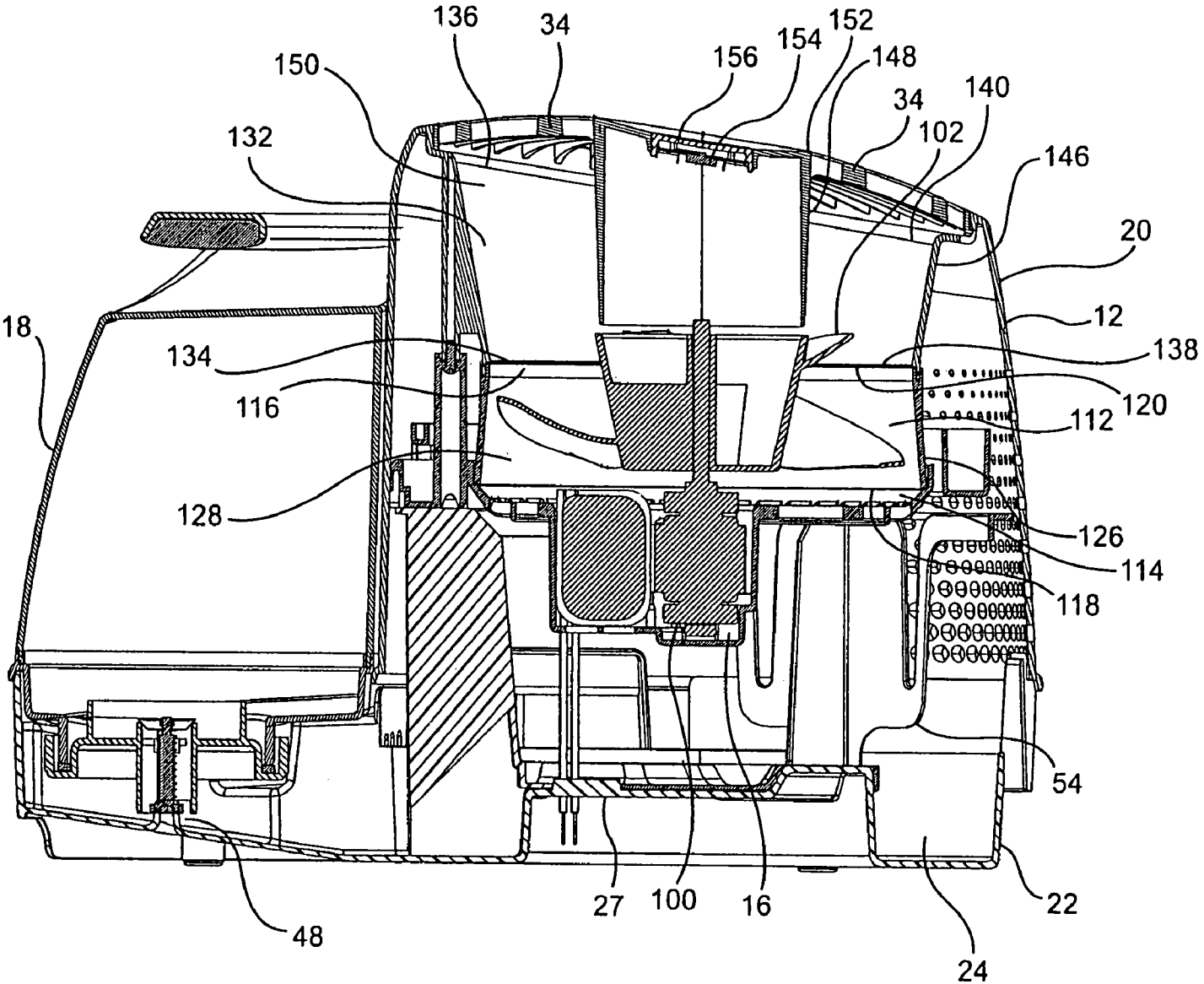
FIG. 4 is a cross-sectional view taken along line 4-4 as shown in FIG. 3.
Figure 9:
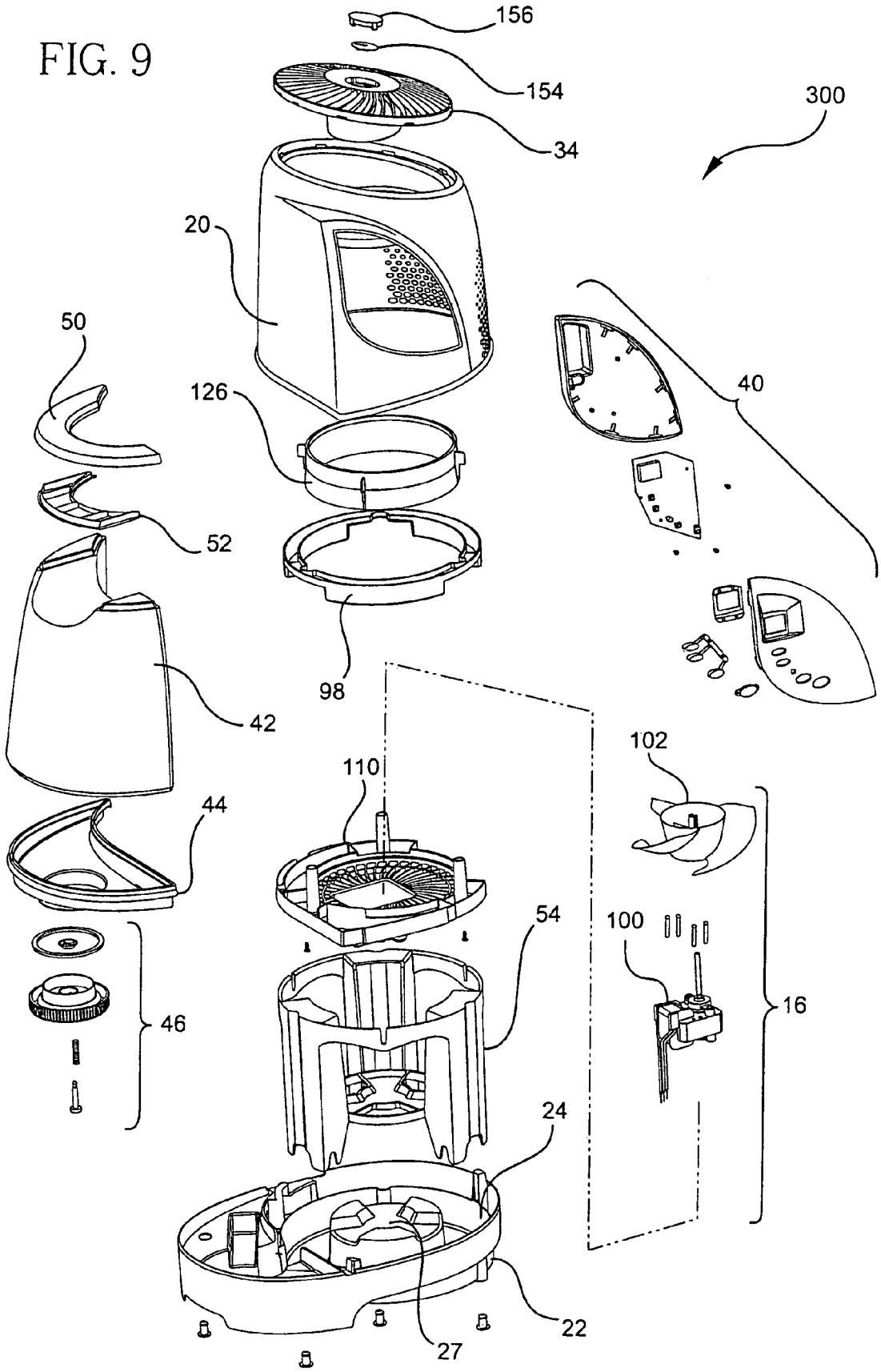
FIG. 9 is an exploded perspective view of the humidifier shown in FIG. 8.
Figure 10:
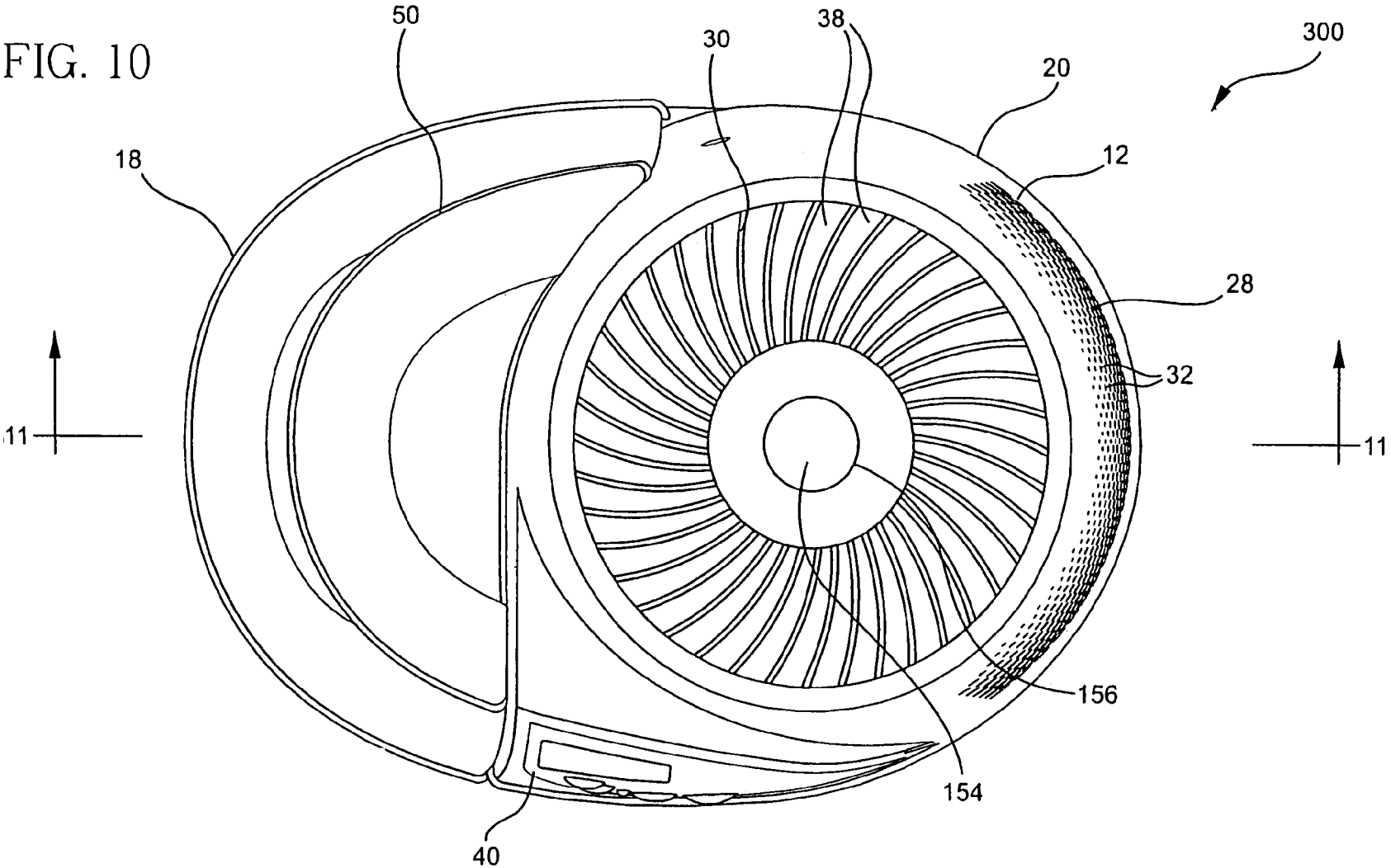
FIG. 10 is a top plan view of the humidifier shown in FIG. 8.
Figure 11:
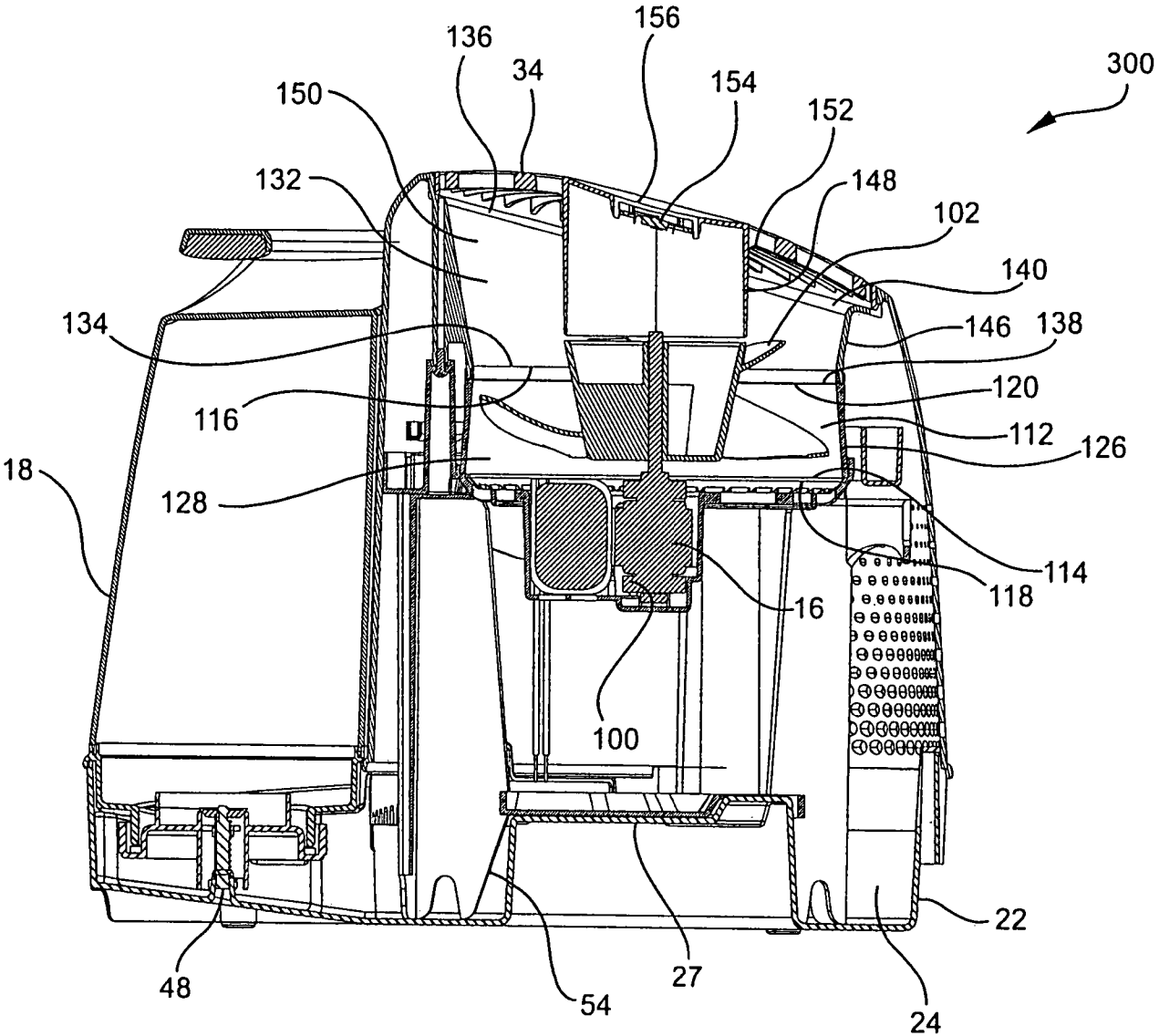
FIG. 11 is a cross-sectional view taken along line 11-11 as shown in FIG. 10.
Figure 17:
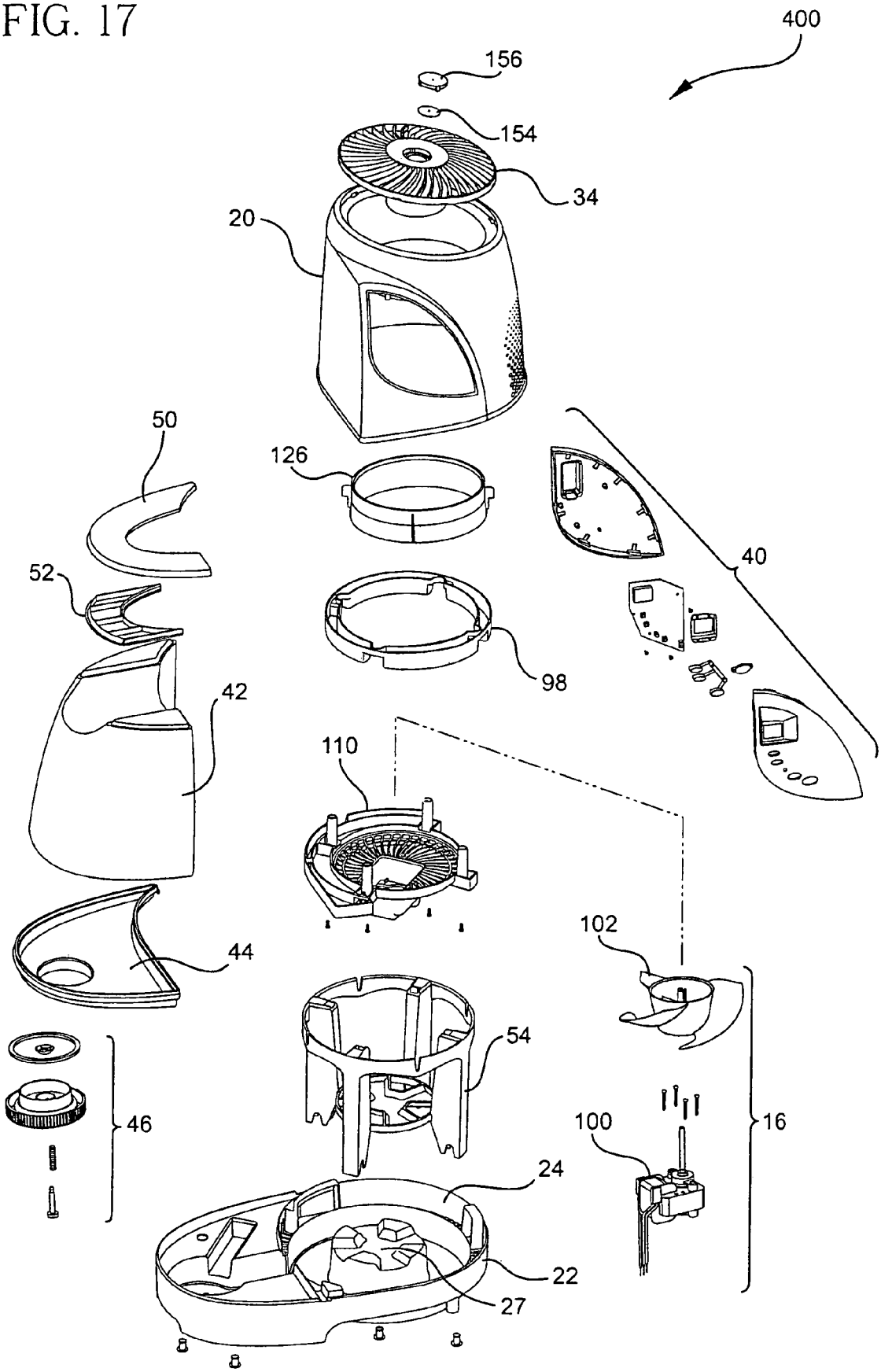
FIG. 17 is an exploded perspective view of the humidifier shown in FIG. 16.
Figure 18:
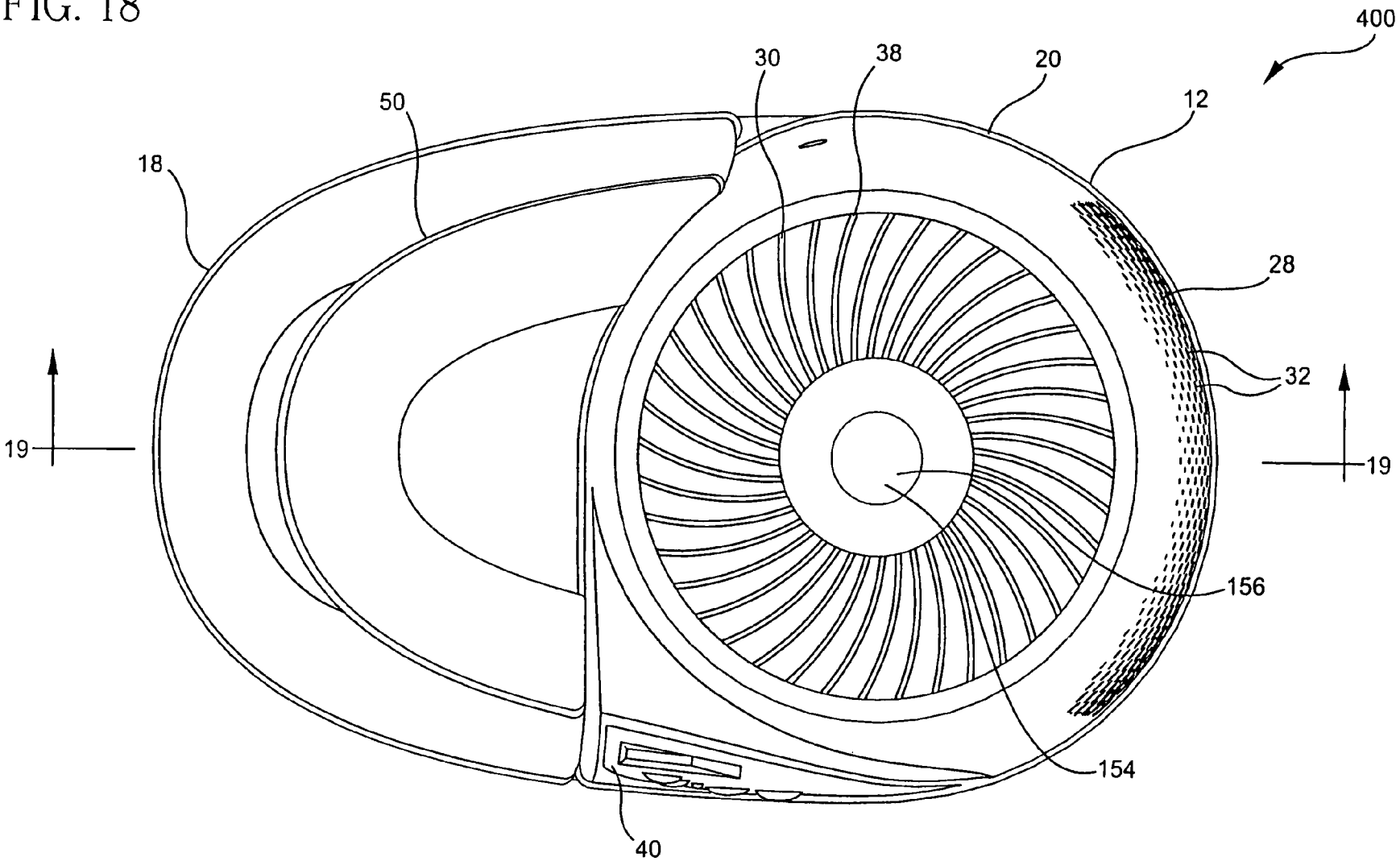
FIG. 18 is a top plan view of the humidifier shown in FIG. 16.
Figure 19:
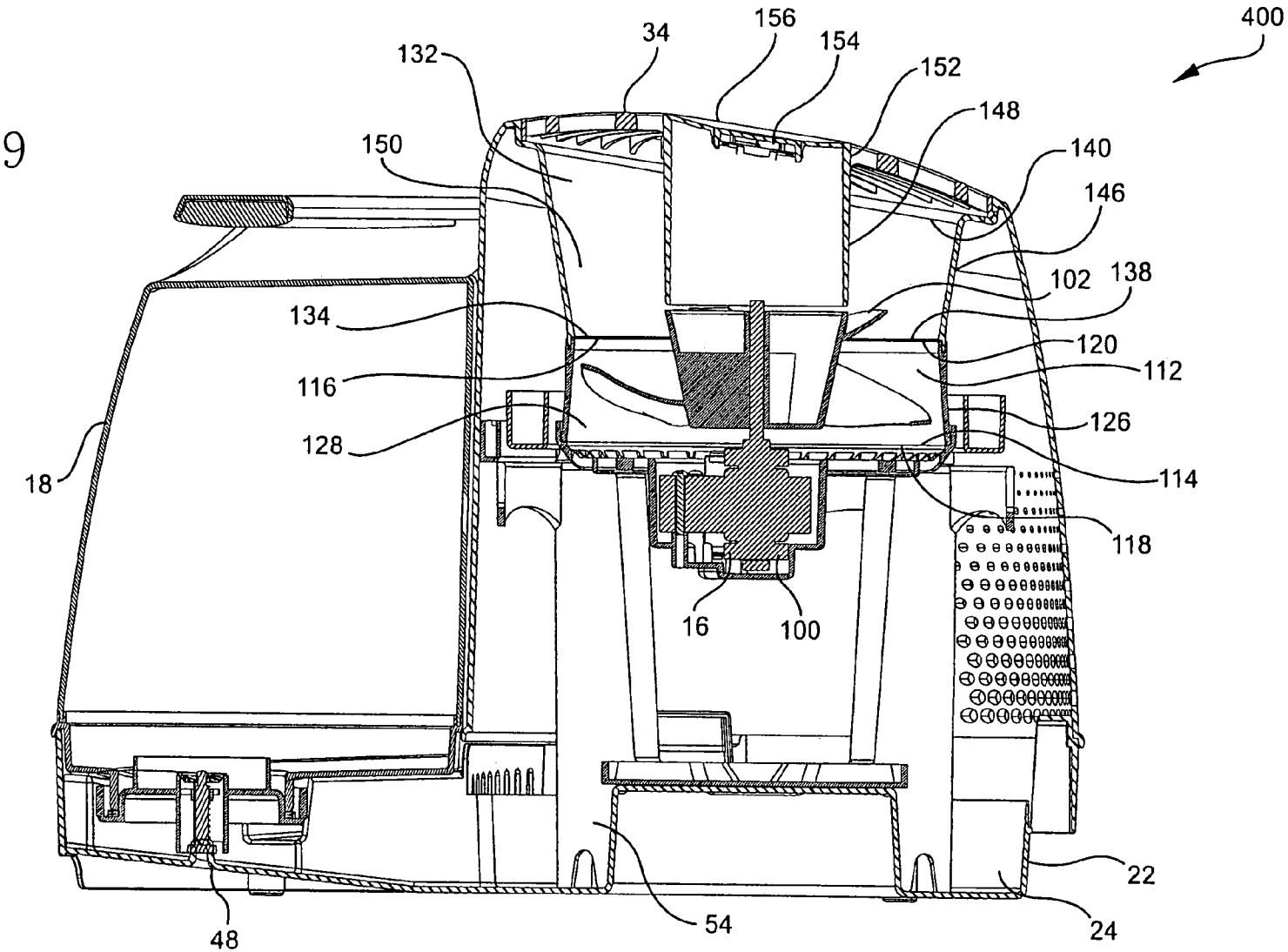
FIG. 19 is a cross-sectional view taken along line 19-19 as shown in FIG. 18.
Figure 20:
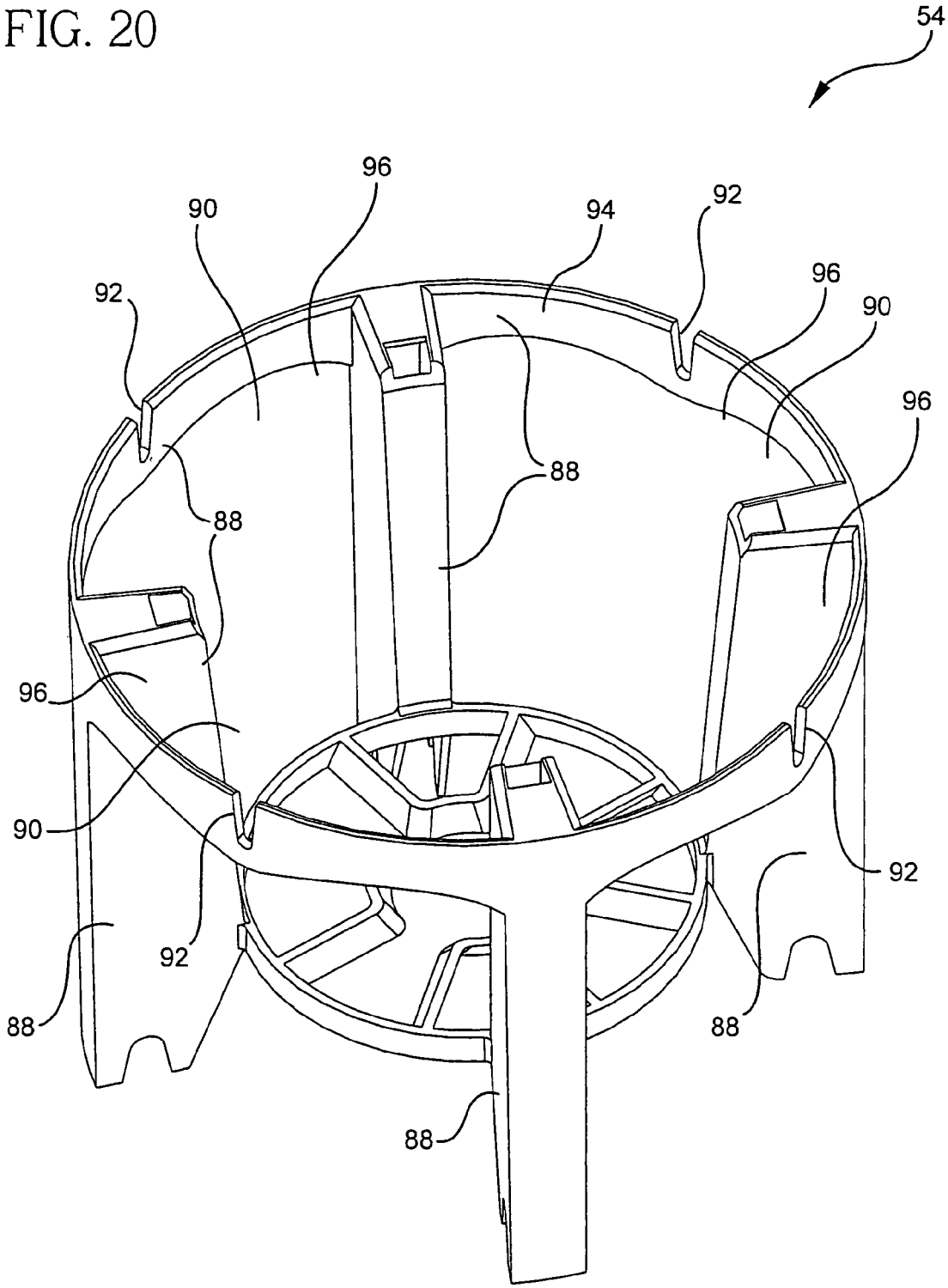
FIG. 20 is a perspective view of the wick frame for the third member of the family of humidifiers.

Referring now to FIGS. 2, 9, and 17, the housing 12 has an upper portion 20 and a bottom portion 22. The bottom portion 22 includes a reservoir 24 for holding water. The reservoir 24 is configured to receive a wick unit 26 for contacting the water in the reservoir 24. As shown in FIGS. 4, 11, and 19, the bottom portion 22 is preferably configured to cooperate with a removable water tank assembly 18 for supplying the reservoir 24 with water. The bottom portion 22 is preferably provided with a pedestal 27 configured to cooperate with the wick frame 54 as shown in FIGS. 2, 9, and 17. The upper portion 20 includes an air inlet 28 and an air outlet 30. The air inlet 28 can be formed as a plurality of openings 32 located on the side of the upper portion 20 as shown in FIGS. 5, 12, and 16. The air outlet 30 is preferably formed as a grill 34 with openings 36. The openings 32, 36 for both the air inlet 28 and air outlet 30 can generally be in any form that allows the free passage of air. The grill 34 can be formed as a plurality of slats 38 as shown in FIGS. 3, 10, and 18. In an alternative embodiment (not shown), the grill 34 can be a metal panel formed with a plurality of perforations. Generally, the upper portion 20 of the housing 12 also supports an electronic control assembly 40 for regulating the operation of the fan 16 and thus the amount of moisture generated by the humidifier 200, 300, 400.

Referring now to FIGS. 2, 9, and 17, the water tank assembly 18 includes a tank 42 and a tank cap 44. A valve assembly 46 is removably mounted in an opening in the tank cap 44. The opening serves as both a filling port and an exiting port. The valve assembly 46 is positioned to engage a valve opening protrusion 48 in the bottom portion 22 of the housing 12 as shown in FIGS. 4, 11, and 19. The water tank assembly 18 can also include a tank top 50 and a tank handle 52.

Figure 23:
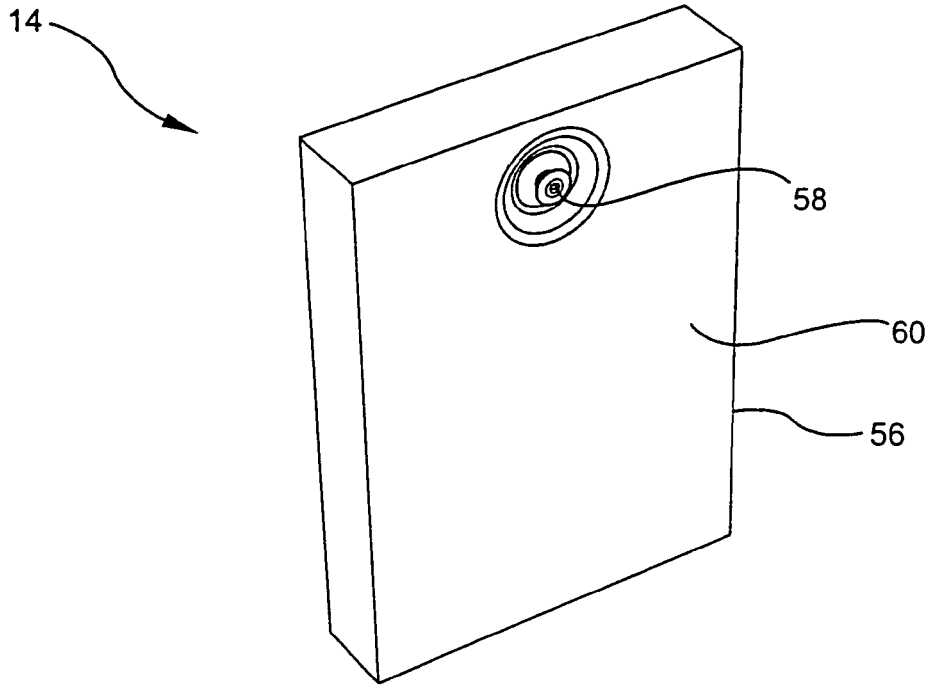
FIG. 23 is a front perspective view of the wick assembly.
Figure 24:
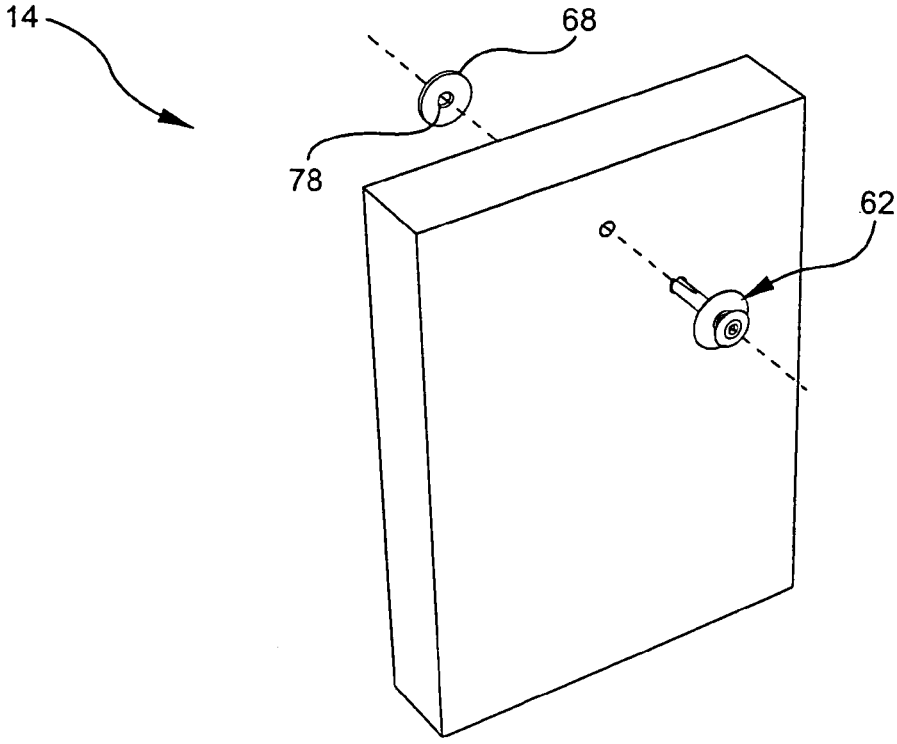
FIG. 24 is an exploded view of the wick assembly shown in FIG. 23.
Figure 25:
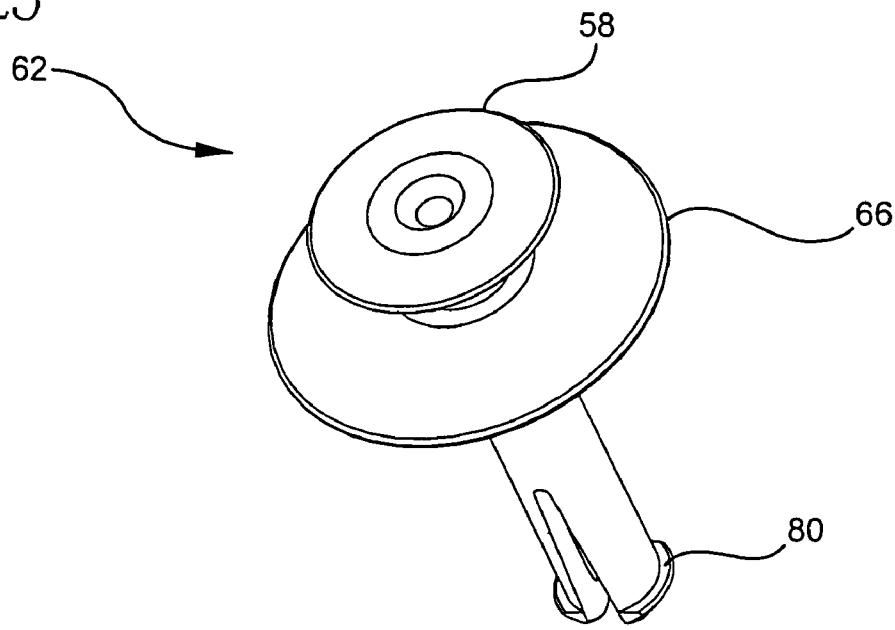
FIG. 25 is a perspective view of the rivet.

Referring now to FIGS. 5, 7, 12, 14, 15, 21, and 22, a wick unit 26 in a preferred embodiment of the present invention includes at least two wick assemblies 14 and a wick frame 54. Each of the wick assemblies 14 includes a wick element 56 and a button 58 which is attached to the wick element 56 as shown in FIGS. 23 and 24. The wick element 56 is fabricated from a material that absorbs fluids. Preferably the wick element 56 is made from expanded cotton/cellulose which possesses excellent capillary action for soaking water from the reservoir 24 up into the wick element 56. The wick element 56 preferably has a substantially uniform thickness and a rectangular shape to define an exterior surface 60. The button 58 is preferably configured to extend from the surface 60. Although the wick unit 26 as described above is preferred, certain aspects of the present invention can be practiced using a standard tubular wick known in art and described in U.S. Pat. No. 6,237,899 to Offir et al., which is incorporated herein by reference. That is, the term wick unit as used herein includes the preferred embodiments disclosed herein as well as the standard tubular wick known in the art.

Figure 26:
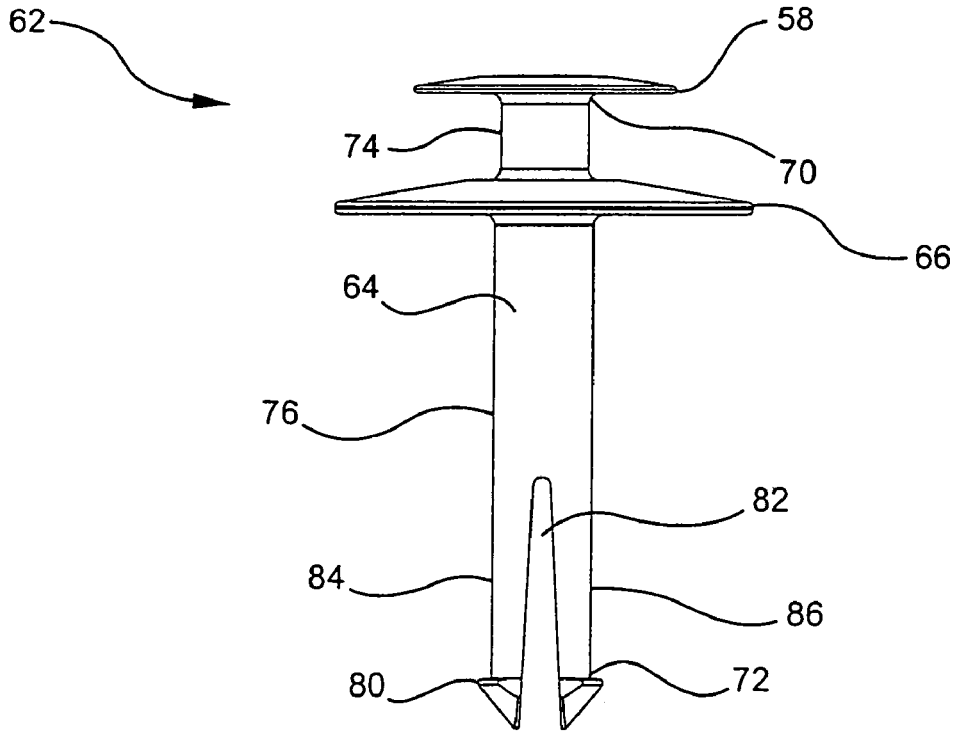
FIG. 26 is a side elevation view of the rivet shown in FIG. 25.
Figure 27:
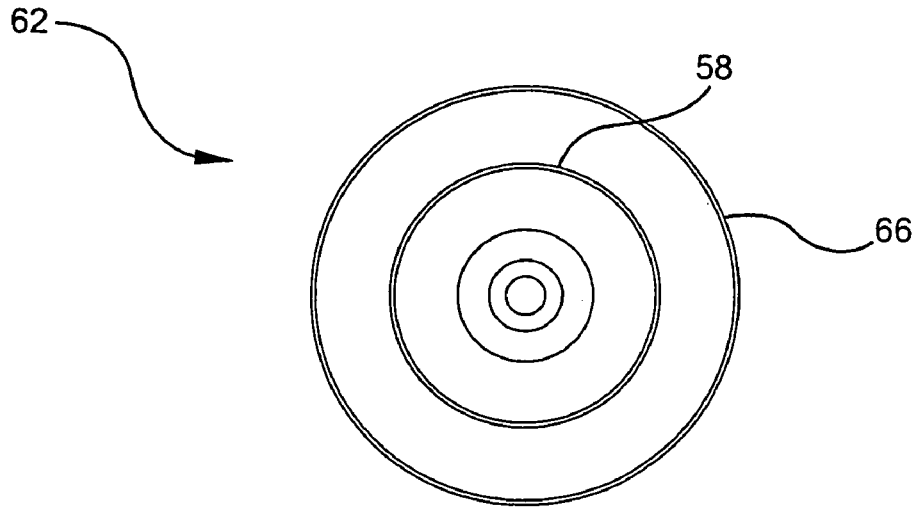
FIG. 27 is a first end elevation view of the rivet shown in FIG. 25.
Figure 28:
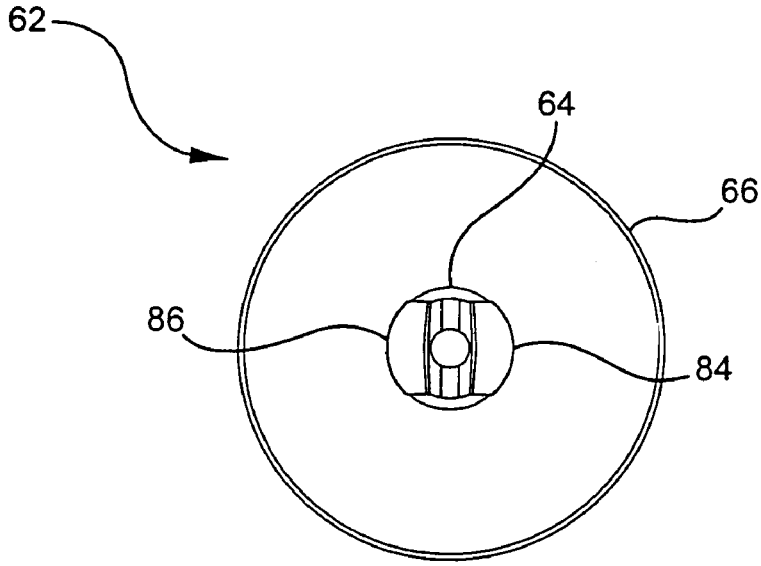
FIG. 28 is a second end elevation view of the rivet shown in FIG. 25.

Referring now to FIGS. 23 through 28, in a preferred embodiment of the invention, the button 58 for the wick assembly 14 is preferably formed as part of a rivet 62. The rivet 62 preferably includes a rod 64, a first retaining plate 66, a second retaining plate 68, and the button 58. The rod 64 is defined as having a first end 70 and a second end 72 with the button 58 being connected to the first end 70 as shown in FIG. 26. The first retaining plate 66 is connected between the first end 70 and the second end 72 to define a first portion 74 and a second portion 76. The first portion 74 of the rod 64 is located between the first end 70 and the first retaining plate 66. The second portion 76 of the rod 64 is located between the first retaining plate 66 and the second end 72. The second retaining plate 68 is connected at the second end 72 of the rod 64 as shown in FIGS. 24 and 28. The second portion 76 of the rod 64 is configured to extend through the wick element 56 so that the wick element 56 is located between the first retaining plate 66 and the second retaining plate 68. The second retaining plate 68 is preferably formed with an opening 78 for receiving the second end 72 of the rod 64. The second end 72 of the rod 64 is preferably formed with a lip 80 for engaging the second retaining plate 68. The second end 72 of the rod 64 is also preferably formed with a slot 82 to define a first prong 84 and a second prong 86. The length of the slot 82 is selected based upon a consideration of the ease of installing and removing the second retaining plate 68 from the second end 72 of the rod 64. That is, so that the first and second prongs 84, 86 can be squeezed together so that the lip 80 can be inserted through the opening 78 in the second retaining plate 68. The cross section of the rod 64 and the opening 78 is preferably circular. The second retaining plate 68 is preferably located on the second portion 76 of the rod 64 between the lip 80 and the wick element 56.

Figure 41:
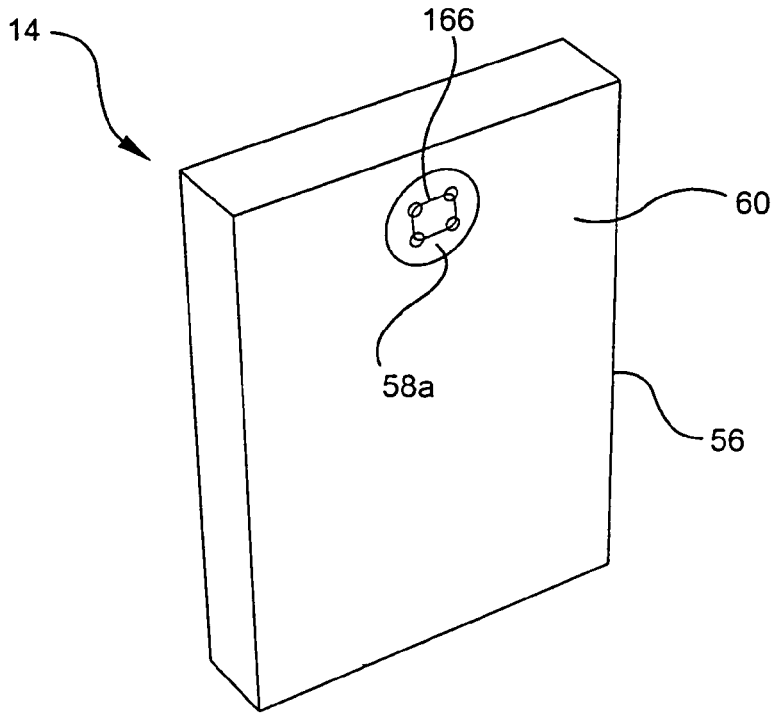
FIG. 41 is a front perspective view of a second embodiment of the wick assembly for the wick frame shown in FIG. 20.
Figure 42:
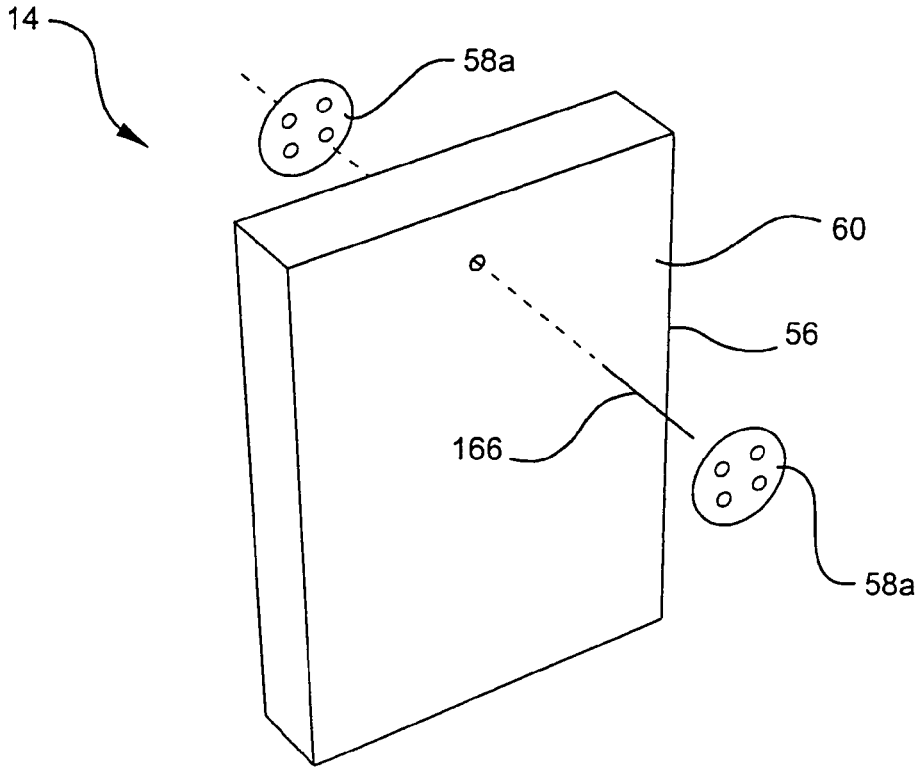
FIG. 42 is an exploded perspective view of the second embodiment of the wick assembly shown in FIG. 41.

Referring now to FIGS. 41 and 42, in a second embodiment of the wick assembly 14 the button 58A can be configured as a conventional shirt or coat button which is sewn to the wick element 56 with a thread 166. The thread 166 is preferably made from a rust resistant material having a tensile strength selected to bias the wick element 56 against the walls 88 of the wick frame 54. The thread 166 can be made from a metal wire or plastic cord. The wick assembly 14 preferably includes a second button 58A for attaching to the other end of the thread 166.

Figure 7:
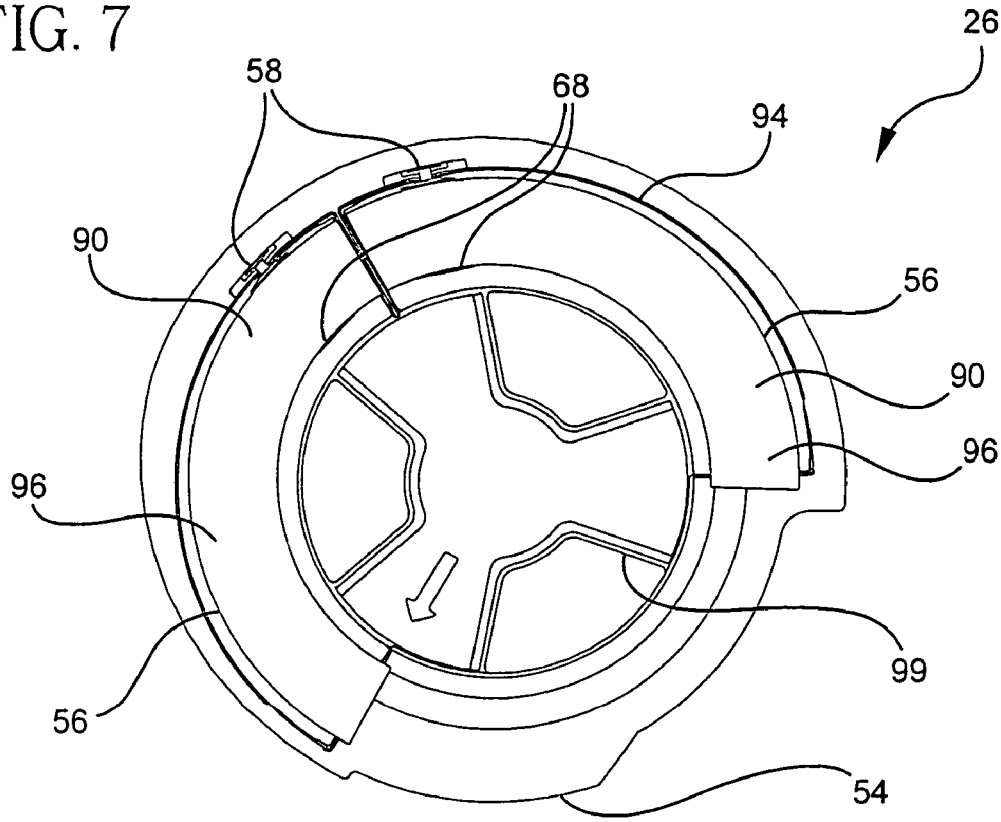
FIG. 7 is a top plan view of the wick frame shown in FIG. 6 with the wick assemblies installed therein.
Figure 14:
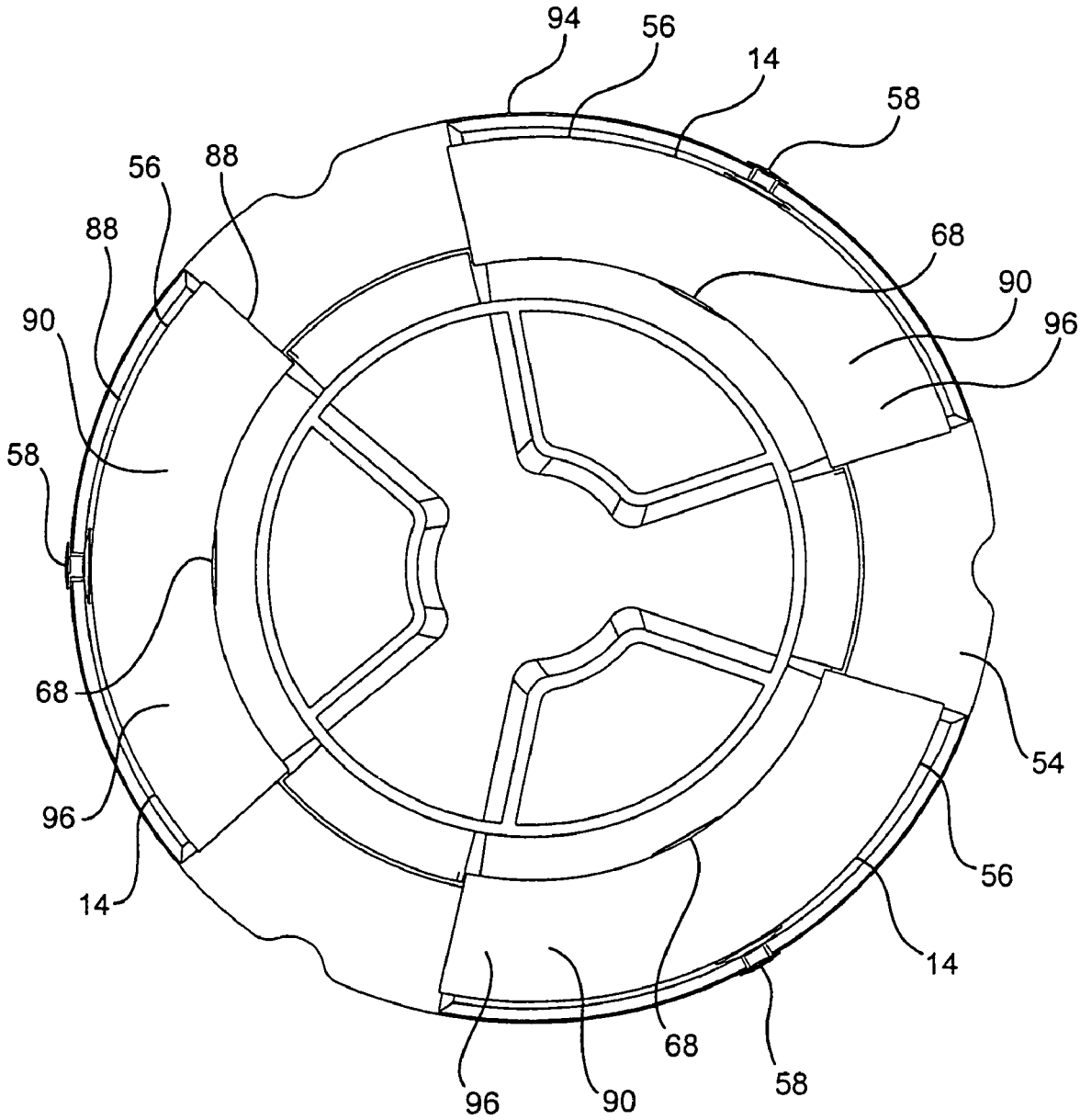
FIG. 14 is a top plan view of the wick frame shown in FIG. 13 with the wick assemblies installed therein.
Figure 15:
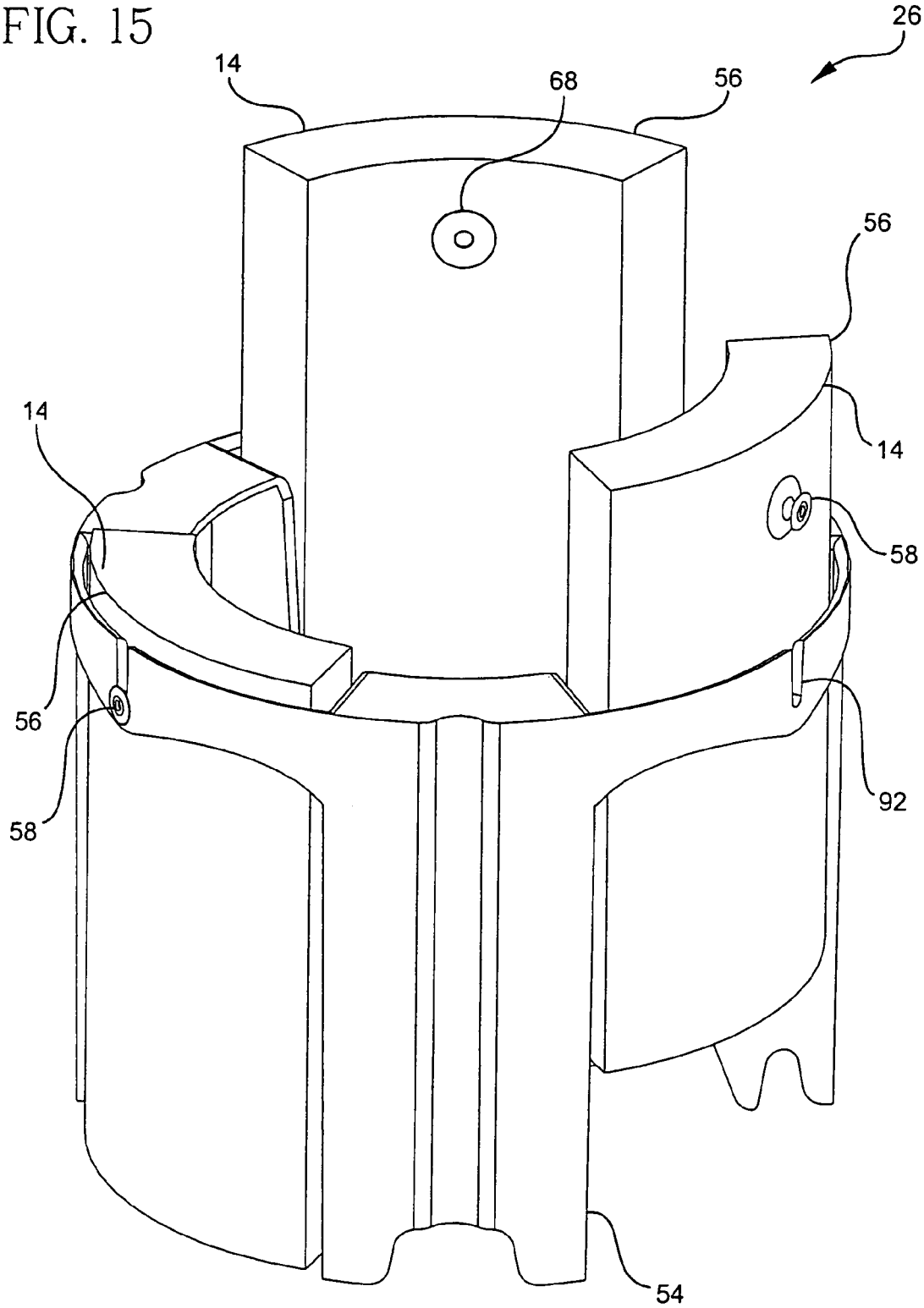
FIG. 15 is a partially exploded perspective view of the wick frame shown in FIG. 13 with the wick assemblies.
Figure 21:
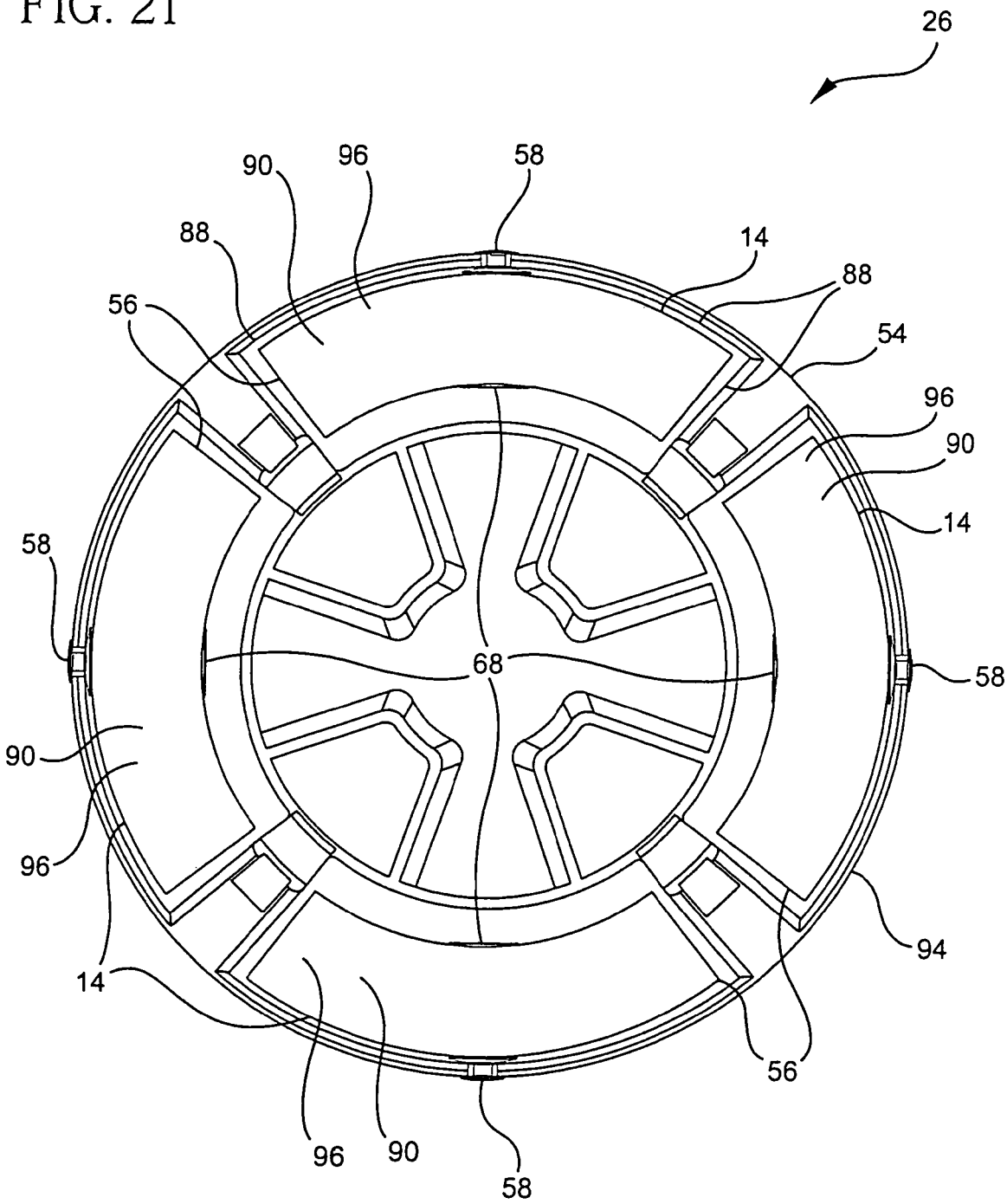
FIG. 21 is a top plan view of the wick frame shown in FIG. 20 with the wick assemblies installed therein.

Referring now to FIGS. 5, 12, and 22, the wick frame 54 supports the wick assembly 14 so that the wick element 56 contacts the water located within the reservoir 24. Preferably the wick frame 54 is configured to support the wick assembly 14 so that a portion of each wick element 56 is partially submerged in the reservoir 24. The wick frame 54 is configured to support the wick assemblies 14 in a parallel arrangement between the air inlet 28 and the fan 16. The parallel arrangement generally results in the air within the airflow encountering only one wick assembly 14 for a given pass through the humidifier 200, 300, 400. Referring now to FIGS. 6, 7, 13 through 15 and 20 through 22, the wick frame 54 has walls 88 formed to define a plurality of spaces 90. Each space 90 is configured to receive one of the wick assemblies 14. The wick frame 54 also includes at least one slot 92 associated with each space 90 for cooperating with the button 58 attached to the wick element 56 as shown in FIGS. 5, 15 and 22. As shown in FIGS. 7, 14 and 21, the wick frame 54 preferably has a substantially circular perimeter 94. In addition, each of the plurality of spaces 90 is preferably configured to have a circular segmented cross section 96. The button 58 is preferably configured to bias the wick element 56 against the walls 88 of the wick frame 54 to conform the rectangular shape of the wick element 56 to the circular segmented cross section 96. In the embodiments of the portable humidifiers 300, 400 shown in FIGS. 8 and 16, the wick frame 54 associated therewith can be configured such that the wick element 56 hangs from the wick frame 54. Each of the plurality of portable humidifiers 200, 300, 400 also preferably includes a ring 98 located within the housing 12 above the wick frame 54. The ring 98 is configured to sit on top of the seated wick elements 56 to prevent the wick elements 56 from floating out of position. The wick frame 54 also preferably includes a key 99 configured to cooperate with the pedestal 27 located in the bottom portion 22 of the housing 12 to ensure that the wick assemblies 14 are properly aligned.

Figure 29:
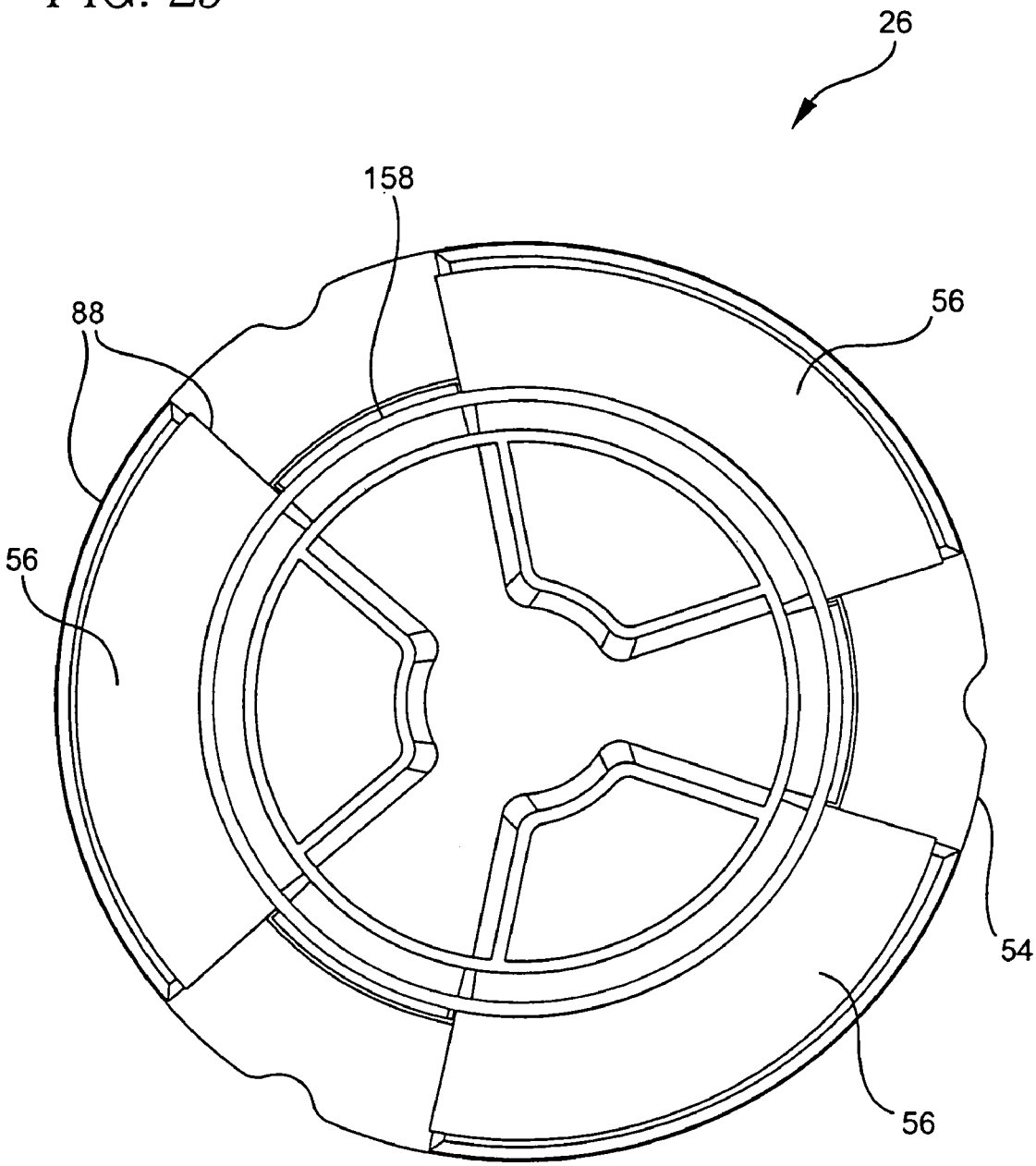
FIG. 29 is a top plan view of a second embodiment of a wick unit for the humidifier shown in FIG. 8.
Figure 30:
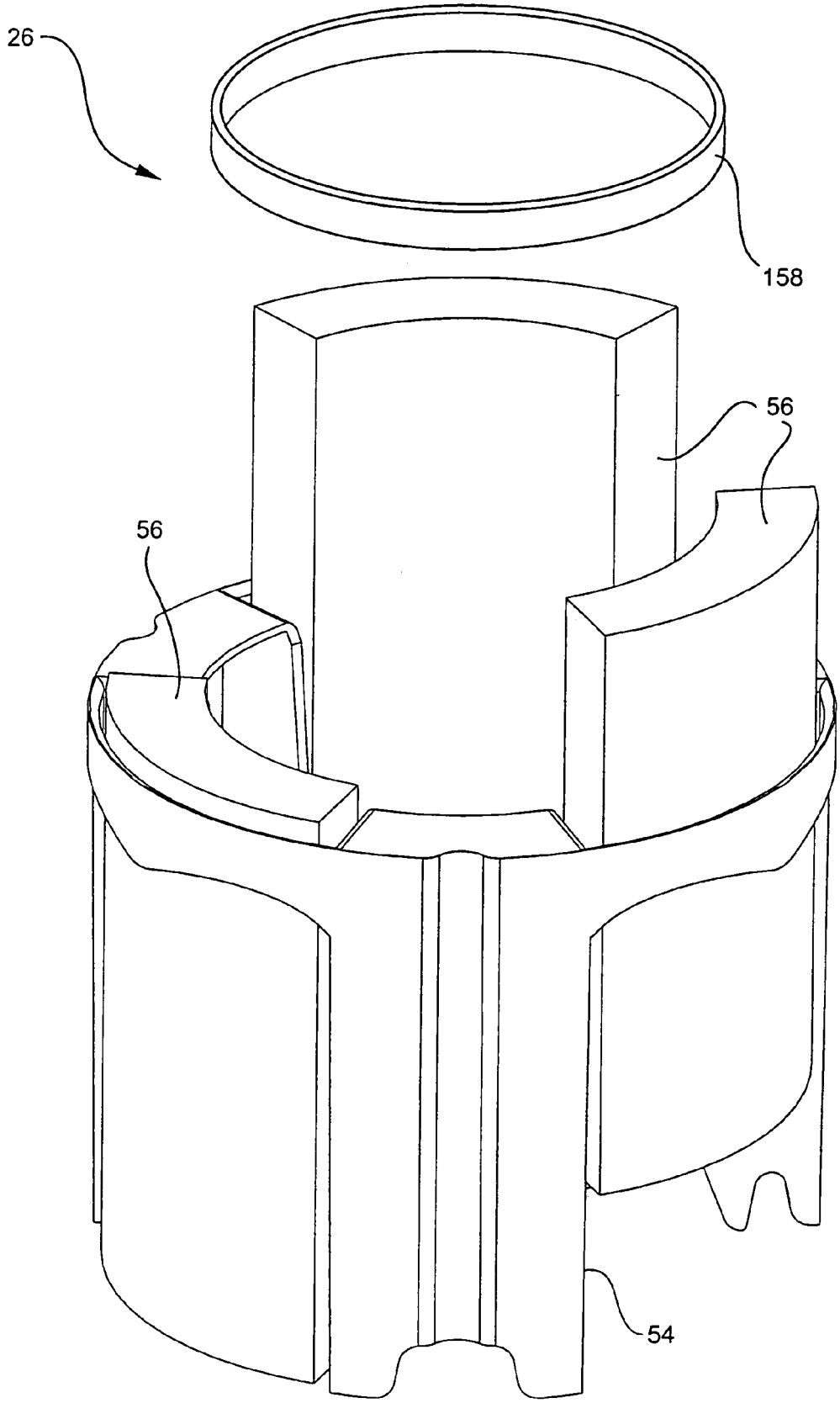
FIG. 30 is a partially exploded perspective view of the wick unit shown in FIG. 29 with the wick assemblies.

Referring now to FIGS. 29 and 30, a second embodiment of a wick unit 26 for the humidifier 300 shown in FIG. 8 includes a wick frame 54, a plurality of wick elements 56, and a biasing ring 158. The biasing ring 158 preferably has a circular shape and is configured to bias portions of the wick elements 56 against the walls 88 of the wick frame 54.

Figure 31:
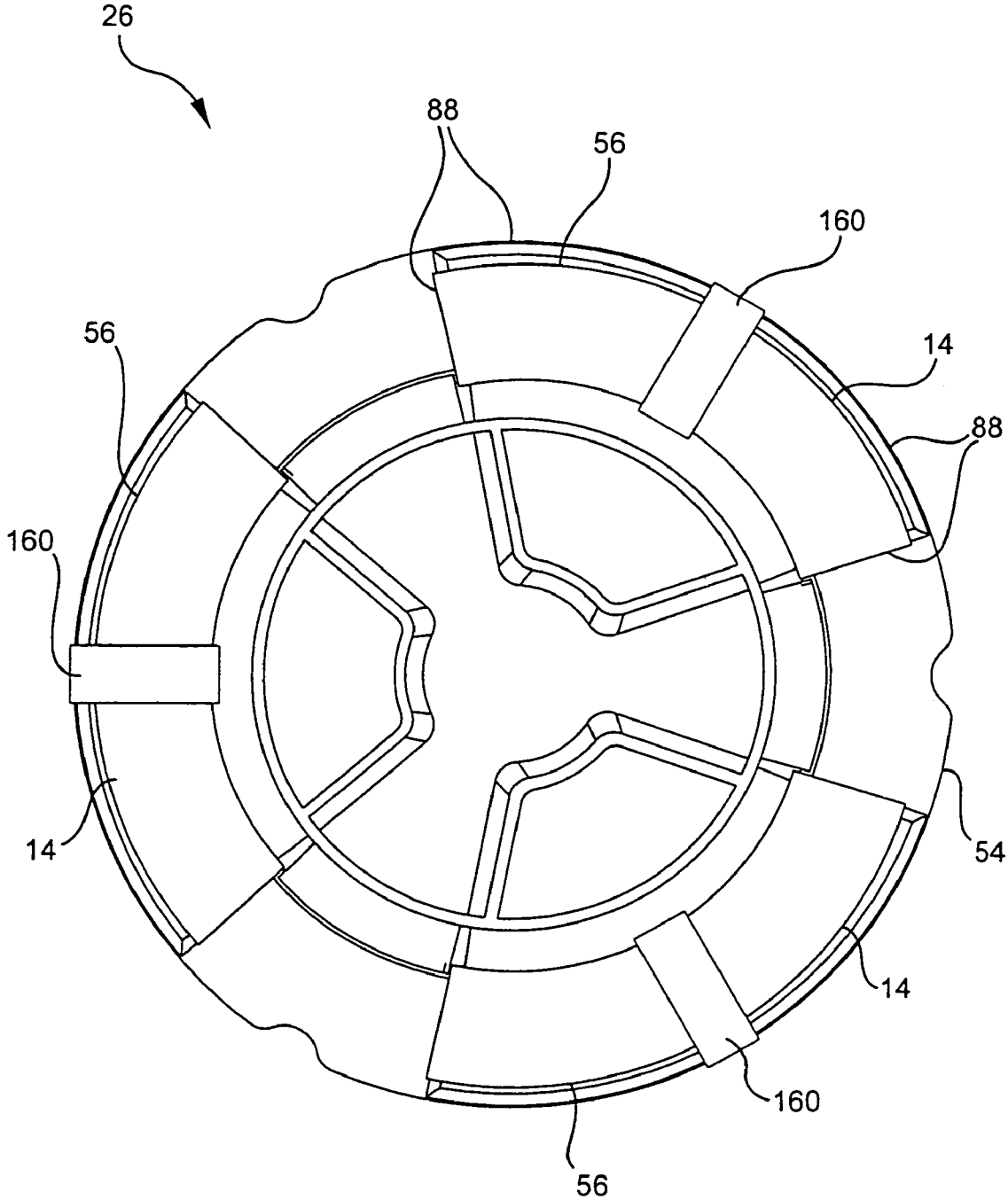
FIG. 31 is a top plan view of a third embodiment of a wick unit for the humidifier shown in FIG. 8.
Figure 32:
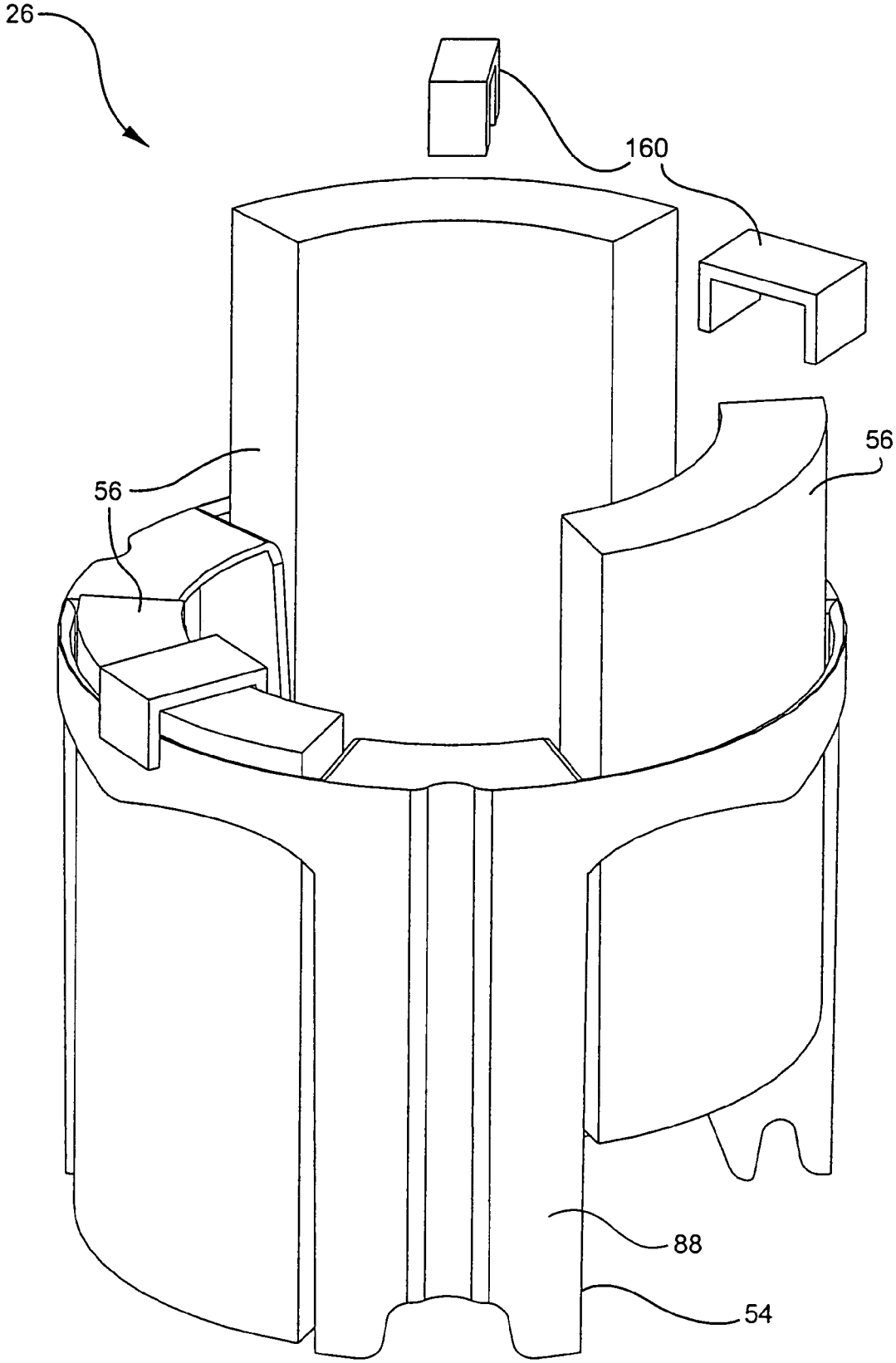
FIG. 32 is a partially exploded perspective view of the wick unit shown in FIG. 31 with the wick assemblies.

Referring now to FIGS. 31 and 32, a third embodiment of a wick unit 26 for the humidifier 300 shown in FIG. 8 includes at least two wick assemblies 14 and a wick frame 54. Each of the wick assemblies 14 includes a wick element 56 and a clamp 160 for biasing portions of the wick elements 56 against the walls 88 of the wick frame. The clamp 160 preferably has a channel shaped and is configured to bias a portion of the inside surface of the wick element 56 between and the outside surface of the walls 88 of the wick frame 54.

Figure 33:
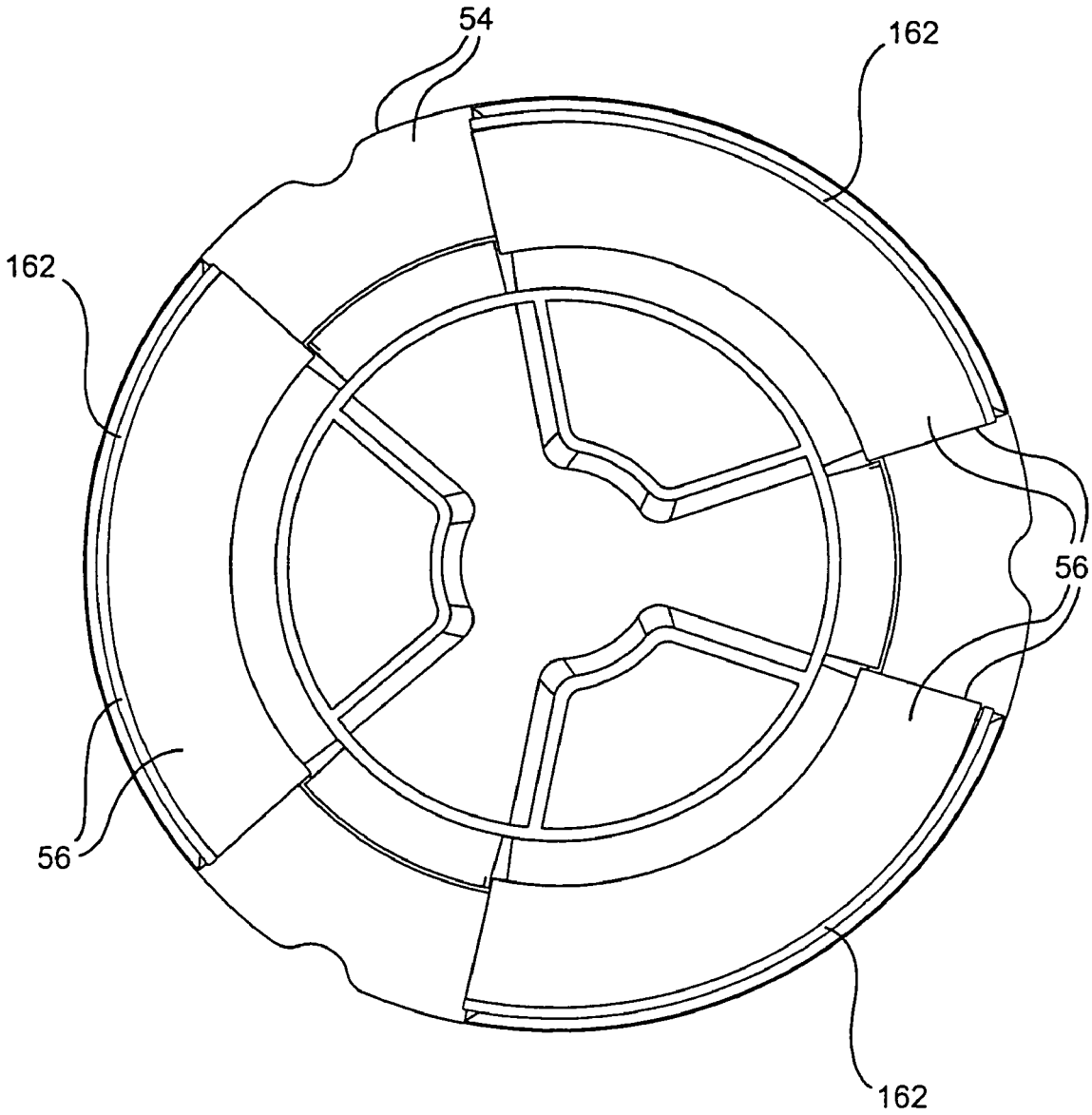
FIG. 33 is a top plan view of a fourth embodiment of a wick unit for the humidifier shown in FIG. 8.
Figure 34:
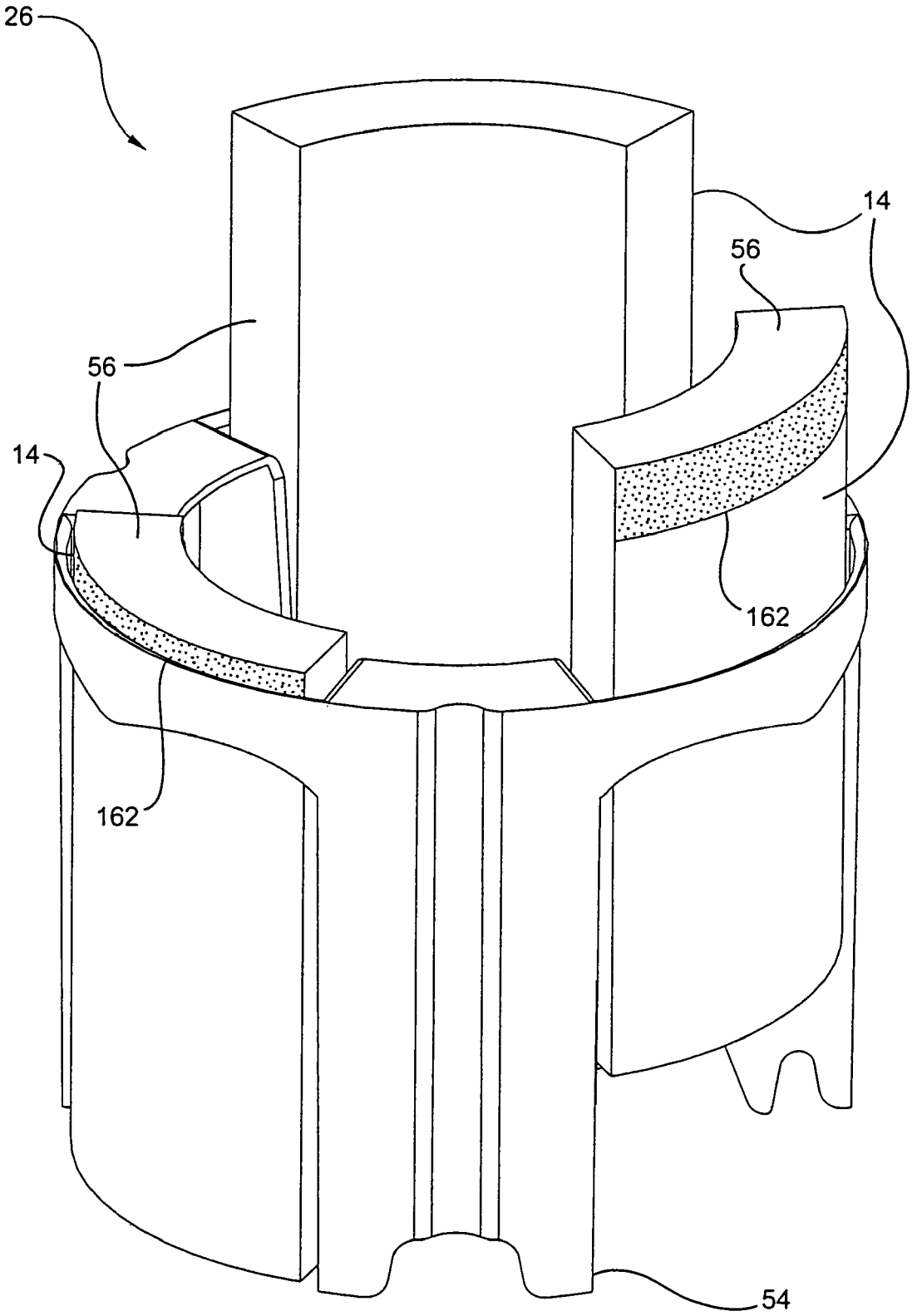
FIG. 34 is a partially exploded perspective view of the wick unit shown in FIG. 33 with the wick assemblies.

Referring now to FIGS. 33 and 34, a fourth embodiment of a wick unit for the humidifier 300 shown in FIG. 8 includes at least two wick assemblies 14 and a wick frame 54. Each of the wick assemblies 14 includes a wick element 56 and a fastener panel 162 attached to the wick element 56. The fastener panel 162 biases portions of the wick elements 56 against the walls 88 of the wick frame 54. The fastener panel 162 can be an adhesive tape, e.g., duct tape. The fastener panel 162 is preferably in the form of a Velcro fastener having one side connected to the inside surface of the walls 88 that define the spaces 90 for the wick elements 56. The other side of the Velcro fastener can be attached to the outside surface of the wick element 56 as shown in FIG. 34.

Figure 35:
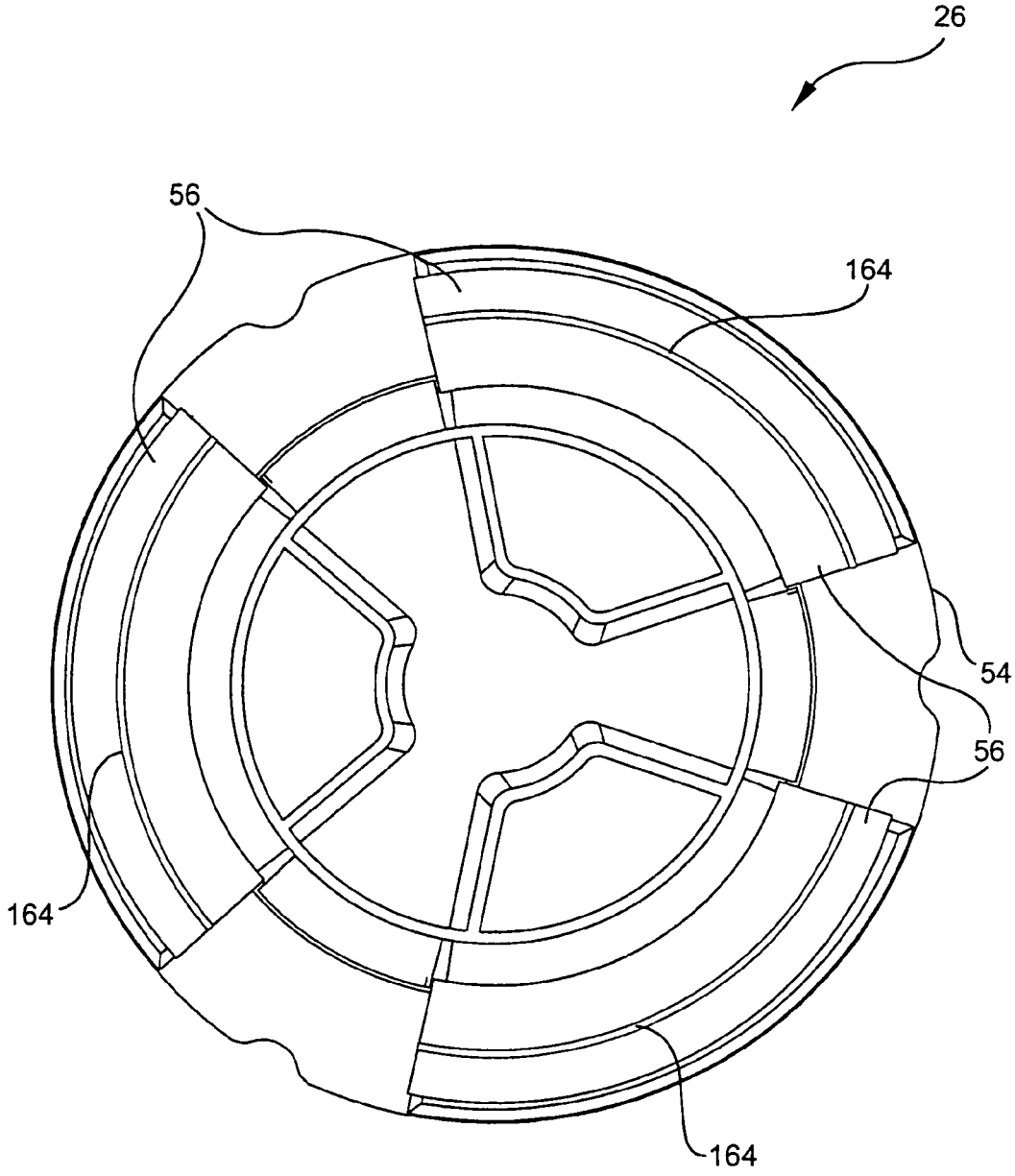
FIG. 35 is a top plan view of a fifth embodiment of a wick unit for the humidifier shown in FIG. 8.
Figure 36:
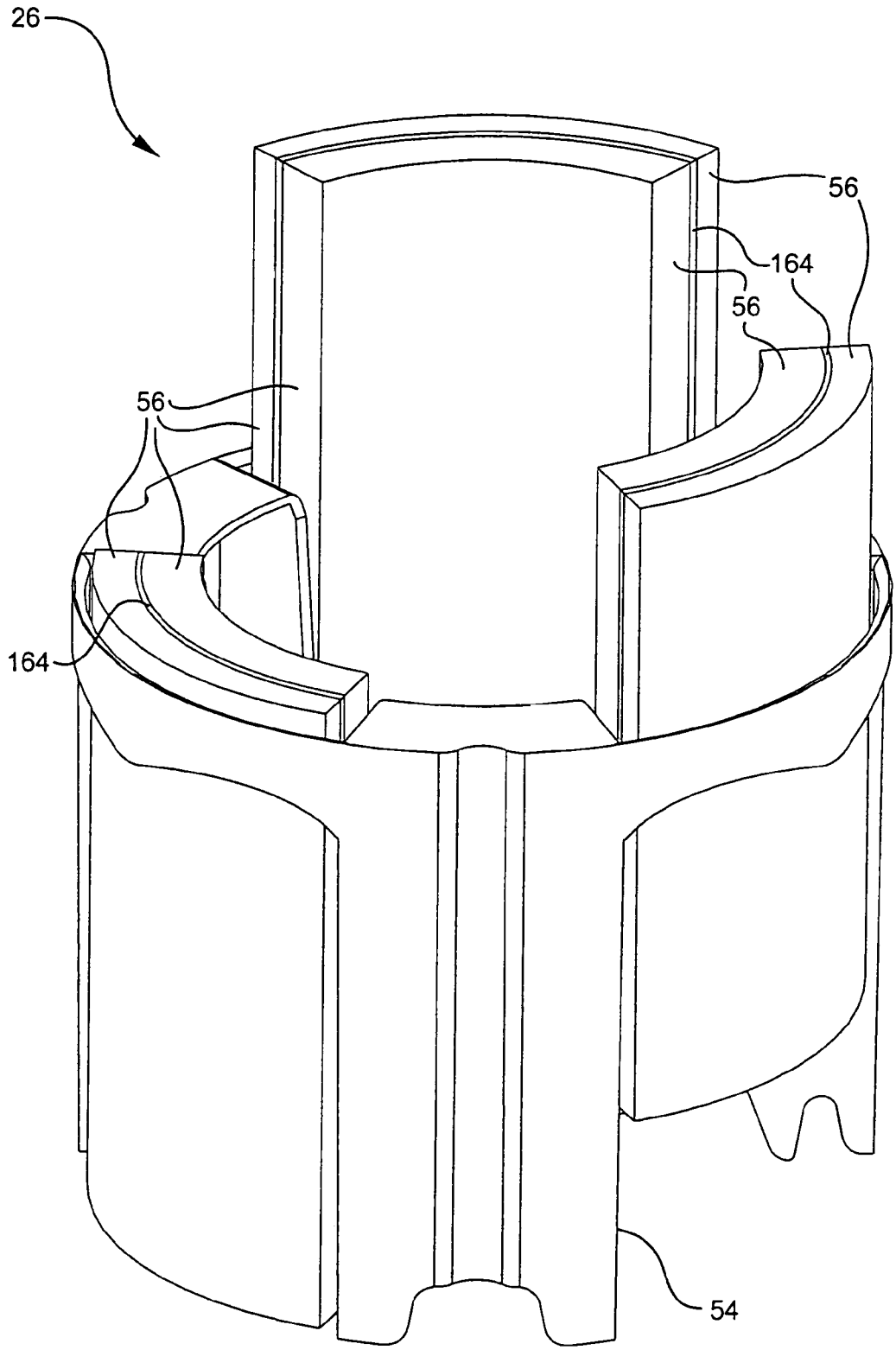
FIG. 36 is a partially exploded perspective view of the wick unit shown in FIG. 35 with the wick assemblies.

Referring now to FIGS. 35 and 36, a fifth embodiment of a wick unit for the humidifier 300 shown in FIG. 8 includes at least two wick assemblies 14 and a wick frame 54. Each of the wick assemblies 14 includes at least one wick element 56 and a wick-element panel 164 attached to the wick element 56. The wick-element panel 164 is perforated to allow air to flow through the wick assembly 14. The wick-element panel 164 biases the wick element 56 within the walls 88 of the space 90. The wick-element panel 164 can be located at either side of the space 90 so that only one wick element 56 is used, or it can be located within the space 90 as shown in FIGS. 35 and 36 for use in conjunction with two wick elements 56. The wick-element panel 164 can be preformed to have a circular profile for cooperating with the circular segmented cross section 96 of the spaces 90. When the wick-element panel 164 is preformed, the panel 164 can generally be made from any suitable rigid material such as a plastic or a rust resistant metal, e.g., aluminum. In a preferred embodiment of the wick assembly 14, the wick-element panel 164 is made from a substantially flat rust resistant metal, e.g., aluminum, and the user forms the panel 164 by manipulating the panel 164 with their hands to fit within the circular segmented cross section 96 of the spaces 90. This is beneficial as it allows the manufacturer to package replacement wick assemblies 14 in smaller rectangular boxes than that which is required for the packaging of filter assemblies 14 having a preformed wick-element panel 164. That is, the packaging will be configured to protect a wick assembly that has a rectangular shaped cross section rather than a circular segmented cross section which is obtained after the manipulation of the wick-element panel 164. When marketing these replacement wick assemblies to consumers, suitable instructions can be provided to explain how the panel is to be manipulated to achieve the appropriate circular profile. The instructions can either be printed on the outside of the packaging materials, e.g., box, or the instructions can be provided as an insert.

Figure 37:
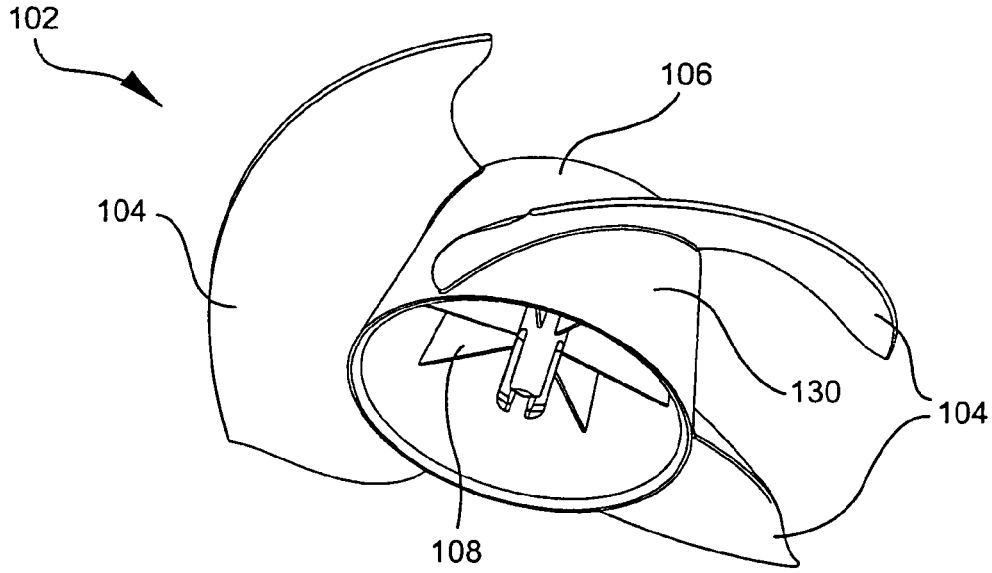
FIG. 37 is a perspective view of the fan blade.
Figure 38:
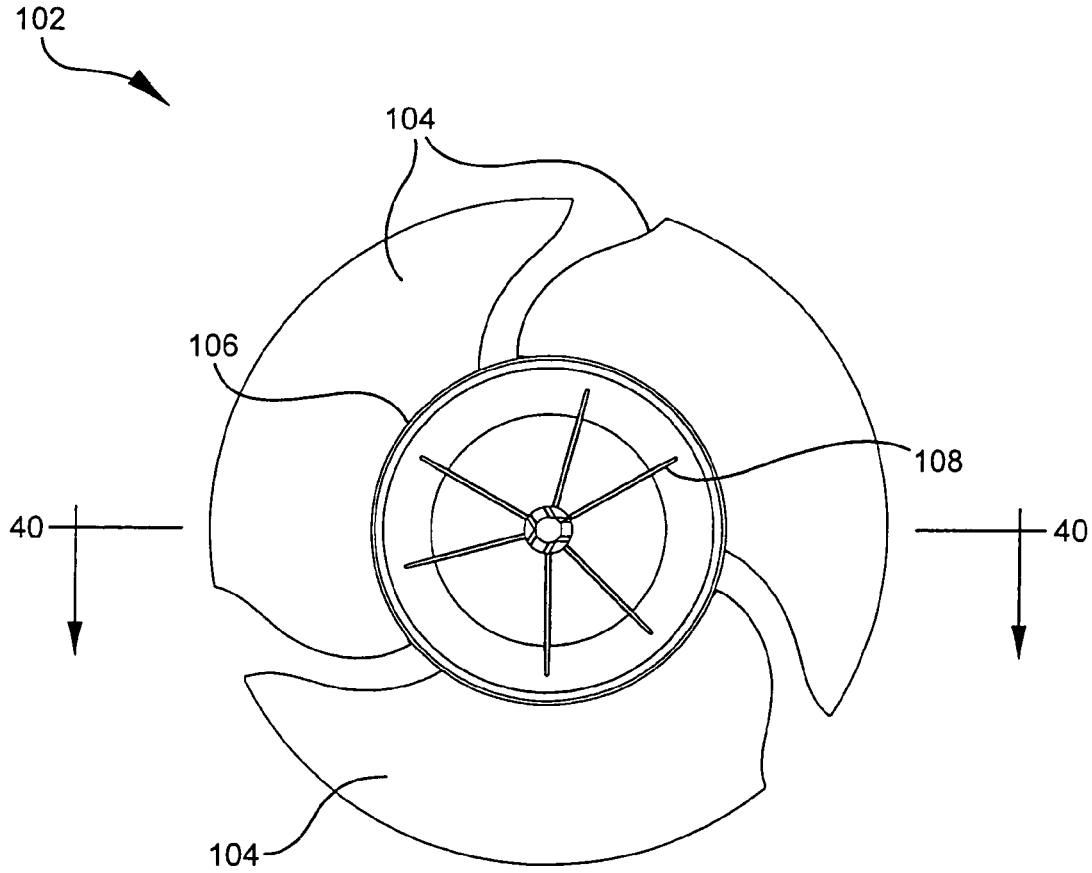
FIG. 38 is a top plan view of the fan blade shown in FIG. 37.
Figure 39:
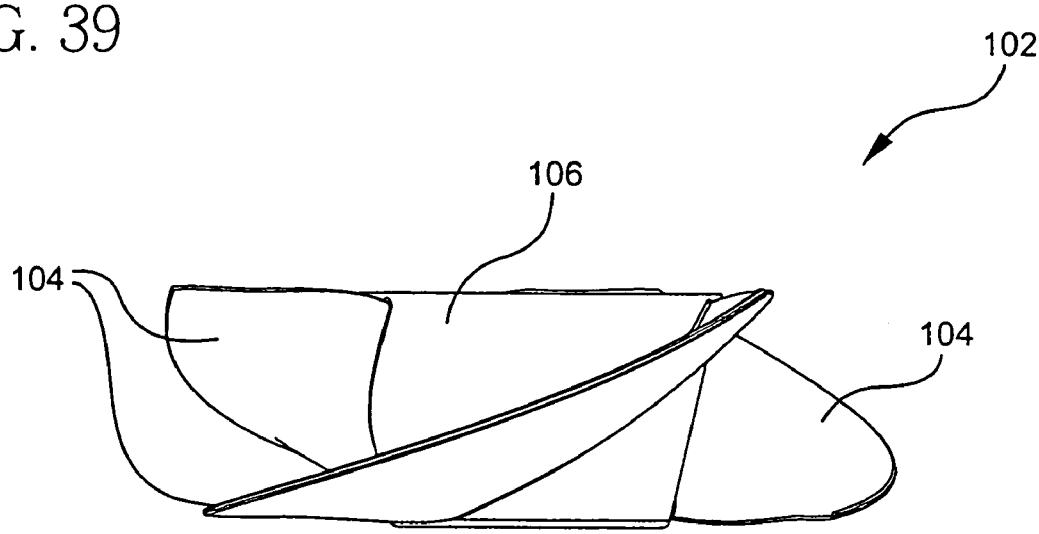
FIG. 39 is a side elevation of the fan blade shown in FIG. 37.
Figure 40:
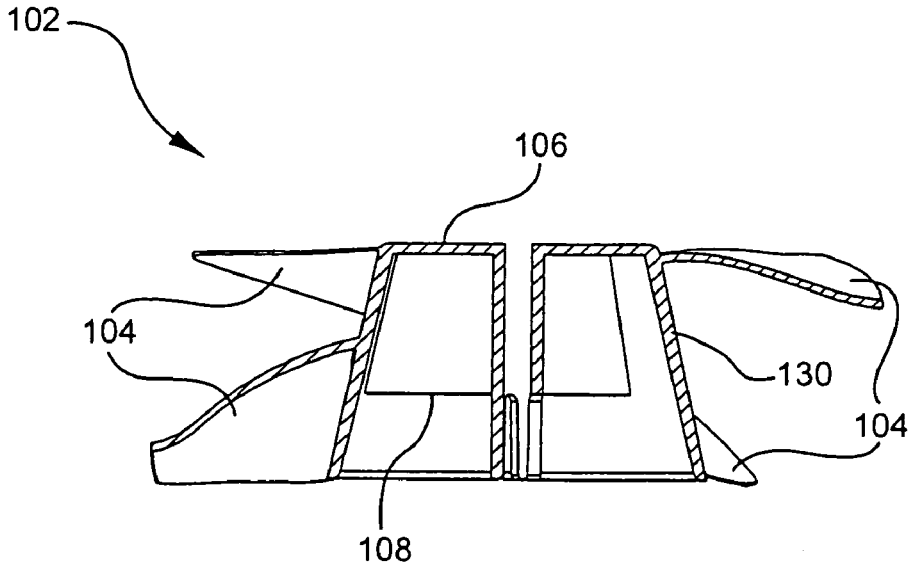
FIG. 40 is a cross-sectional view taken along line 40-40 as shown in FIG. 38.

Referring now to FIGS. 4, 11, and 19, the fan 16 is provided within the housing 12 for creating an airflow that passes through the humidifier 200, 300, 400. The fan 16 includes a motor 100 and a propeller 102. The propeller 102 includes at least one fan blade 104 and preferably three fan blades 104 as shown in FIGS. 37 and 38. The propeller 102 can also include a hub 106 as shown in FIGS. 39 and 40. The propeller 102 also preferably includes one or more fins 108 located within the hub 106. The motor 100 is preferably an electric motor 100 which is supported within the housing 12 by a motor frame 110. The fan 16 initially draws relatively dry air in through the air inlet 28 of the housing 12. The airflow next passes through the wick assemblies 14 for adding moisture to the airflow from the water in the reservoir 24. The airflow generally exits through the air outlet 30 having a higher relative humidity.

Referring again to FIGS. 4, 11, and 19, in a preferred embodiment of the present invention the housing 12 includes a contraction zone 112 having an entrance 114 and an exit 116 for increasing the mean velocity of the airflow. The mean velocity of the airflow is equal to the volume flow rate divided by the cross sectional area. The entrance 114 has a first-air-flow area 118 and the exit 116 has a second-air-flow area 120 associated therewith to accommodate the airflow. The first-air-flow area 118 is preferably larger than the second-air-flow area 120. The first-air-flow area 118 and the second-air-flow area 120 are preferably defined by a first inner perimeter and a first outer perimeter. The first outer perimeter at the entrance 114 is preferably larger than the first outer perimeter at the exit 116. The first inner perimeter at the entrance 114 is preferably smaller than the first inner perimeter at the exit 116.

Referring again to FIGS. 2, 9, and 17, the contraction zone 112 is preferably defined by a first tapered sleeve 126 and the hub 106. The tapered sleeve 126 is located between the entrance 114 and the exit 116, and has a first inner surface 128 which defines the first outer perimeter. The first inner surface 128 is selected to have a diameter that contracts from the entrance 114 to the exit 116 to minimize tip leakage flow between the fan blades 104 and the tapered sleeve 126. The hub 106 is preferably formed as part of the propeller 102 and is also located between the entrance 114 and the exit 116 of the contraction zone 112. The hub 106 preferably includes a substantially conical frustum shaped side surface 130 for defining the first inner perimeter. The diameter of the hub 106 expands from the entrance 114 to the exit 116 thereby further contracting the cross sectional area through the contraction zone 112. The expansion of the hub 106 helps eliminate separation in the airflow adjacent to the hub 106. In an alternative embodiment (not shown), the hub 106 can be formed as part of the housing 12 and the fan blades 104 of the propeller 102 can be configured to rotate about the hub 106.

Referring again to FIGS. 4, 11, and 19, in a preferred embodiment of the present invention the housing 12 includes a diffusion zone 132 located between the contraction zone 112 and the air outlet 30 to reduce the mean velocity of the airflow. The diffusion zone 132 is generally defined by a first end 134 adjacent to the contraction zone 112 and a second end 136 adjacent to the air outlet 30. The first end 134 has a third-air-flow area 138 and the second end 136 has a fourth-air-flow area 140 associated therewith to accommodate the airflow. The third-air-flow area 138 is preferably smaller than the fourth-air-flow area 140. The third-air-flow area 138 and the fourth-air-flow area 140 are preferably defined by a second inner perimeter and a second outer perimeter 144. The second outer perimeter at the first end 134 is preferably smaller than the second outer perimeter at the second end 136. The second inner perimeter at the first end 134 is preferably substantially equal to the second inner perimeter at the second end 136.

Referring again to FIGS. 2, 9, and 17, the diffusion zone 132 is preferably defined by a second tapered sleeve 146 and a tube 148. The second tapered sleeve 146 is located between the first end 134 and the second end 136 of the diffusion zone 132. The second tapered sleeve 146 preferably has a second inner surface 150 which defines the second outer perimeter 144. The tube 148 is preferably located between the first end 134 and the second end 136 of the diffusion zone 132. The tube 148 has a substantially cylindrical shaped side surface 152 which defines the second inner perimeter 142. The air outlet 30 is preferably formed as a grill 34 at the second end 136 of the diffusion zone 132, and the tube 148 is connected to the grill 34.

Referring now to FIGS. 2, 4, 9, 11, 17, and 19, in preferred embodiments of the present invention, the portable humidifier 200, 300, 400 includes a wick change indicator 154 located at the center of the grill 34 that defines the air outlet 30, and is enclosed by a clear plastic cover 156. The wick change indicator 154 preferably includes a hygrometer as described in U.S. Pat. Nos. 6,237,899 and 6,523,810 both to Offir, et al., which are incorporated herein by reference. The wick change indicator 154 is in fluid communication with the interior of the tube 148 to measure the exit-relative humidity of the airflow. The propeller 102 is preferably provided with fins 108 within the hub 106 so that the air within the tube 148 is refreshed to ensure that the wick change indicator 154 receives a portion of the air flow.

Although illustrative embodiments of the present invention have been described herein with reference to the accompanying drawings, it is to be understood that the invention is not limited to those precise embodiments, and that various other changes and modifications may be effected by one skilled in the art without departing from the scope or spirit of the invention.

What is claimed is:

1. A humidifier comprising:

a housing including an air inlet, an air outlet and a reservoir for holding water;

a wick frame disposed within said housing, said wick frame having a peripheral wall and a plurality of side walls extending from said peripheral wall to define at least one space;

a wick element configured to be received by said space of said wick frame whereby said wick element is positioned within said housing to contact the water in said reservoir and arranged in parallel between said air inlet and said fan, said wick element having an exterior surface and a thickness perpendicular to said exterior surface;

a fastening means for attaching said exterior surface of said wick element to said peripheral wall of said wick frame; and a fan provided within said housing for creating an airflow, the airflow entering said air inlet, passing through said wick element for adding moisture to the airflow from the water in said reservoir and exiting through said air outlet.

2. A humidifier as defined in claim 1, wherein said fastening means is adapted to bias said exterior surface of said wick element against a circular peripheral wall of said wick frame, whereby said wick element is formed into a shape having a circular segmented cross-section.

3. A humidifier as defined in claim 1, wherein said fastening means is at least one of:

a hanger;

a button;

a biasing ring;

a clamp;

a fastener panel; and a wick-element panel.

4. A humidifier comprising:

a housing including an air inlet, an air outlet and a reservoir for holding water;

a wick element supported in said housing to contact the water in said reservoir and arranged in parallel between said air inlet and said fan, said wick element being comprised of an absorbent material and having an inner surface and an outer surface defining a thickness of said wick element therebetween;

a hanger including a fastener portion coupled to said wick element and a hanger portion coupled to said housing, said hanger portion extending outwardly from said outer surface of said wick element and including a neck portion extending away from said outer surface of said wick element and a head portion coupled to said neck portion; and a fan provided within said housing for creating an airflow, the airflow entering said air inlet, passing through said wick element for adding moisture to the airflow from the water in said reservoir and exiting through said air outlet.

5. A humidifier as defined in claim 4, wherein said hanger portion of said hanger includes a first retaining member having a surface in opposing relation to a surface of said head portion, said fastener portion extending from said first retaining member into said wick element and said neck portion extending between said first retaining member and said head portion.

6. A humidifier as defined in claim 5, wherein said hanger portion of said hanger is configured to receive opposing edge portions of an elongate slot formed in said housing between said first retaining plate and said head portion while said neck portion extends through the slot.

7. A humidifier comprising:

a housing including an air inlet, an air outlet, an annular contraction zone and a reservoir for holding water;

a wick unit positioned within said housing to contact the water in said reservoir; and a fan having a propeller provided within said housing for creating an airflow having a mean velocity, said propeller being located within said contraction zone and defining a central axis of propeller rotation, said propeller including a conical hub coaxially aligned with said central axis, said hub defining an inner boundary of said annular contraction zone, whereby said contraction zone is conically tapered with respect to said central axis, the airflow entering said air inlet, passing through said wick unit for adding moisture to the airflow from the water in said reservoir, passing through said contraction zone for increasing the mean velocity of the airflow and exiting through said air outlet.

8. A humidifier as defined in claim 7, wherein said contraction zone includes:

an entrance having a first-air-flow area to accommodate the airflow; and an exit having a second-air-flow area to accommodate the airflow, wherein said first-air-flow area is larger than said second-air-flow area, and wherein said contraction zone is defined by air-flow areas which continuously decrease from said first-air-flow area to said second-air-flow area.

9. A humidifier, comprising:

a housing including an air inlet, an air outlet, a contraction zone and a reservoir for holding water;

a wick unit positioned within said housing to contact the water in said reservoir; and a fan having a propeller provided within said housing for creating an airflow having a mean velocity, said propeller being located within said contraction zone and defining a central axis of propeller rotation, said contraction zone being conically tapered with respect to said central axis, the airflow entering said air inlet, passing through said wick unit for adding moisture to the airflow from the water in said reservoir, passing through said contraction zone for increasing the mean velocity of the airflow and exiting through said air outlet, wherein said contraction zone includes:

an entrance having a first-air-flow area to accommodate the airflow; and an exit having a second-air-flow area to accommodate the airflow, wherein said first-air-flow area is larger than said second-air-flow area, and wherein said contraction zone is defined by air-flow areas which continuously decrease from said first-air-flow area to said second-air-flow area, and wherein said first-air-flow area and said second-air-flow area are defined by an inner perimeter and an outer perimeter, wherein said outer perimeter at said entrance is larger than said outer perimeter at said exit.

10. A humidifier comprising:

a housing including an air inlet, an air outlet, a contraction zone and a reservoir for holding water;

a wick unit positioned within said housing to contact the water in said reservoir; and a fan having a propeller provided within said housing for creating an airflow having a mean velocity, said propeller being located within said contraction zone, the airflow entering said air inlet, passing through said wick unit for adding moisture to the airflow from the water in said reservoir, passing through said contraction zone for increasing the mean velocity of the airflow and exiting through said air outlet, wherein said contraction zone includes:

an entrance having a first-air-flow area to accommodate the airflow; and an exit having a second-air-flow area to accommodate the airflow, wherein said first-air-flow area is larger than said second-air-flow area, and wherein said first-air-flow area and said second-air-flow area are defined by an inner perimeter and an outer perimeter, wherein said outer perimeter at said entrance is larger than said outer perimeter at said exit, and wherein said inner perimeter at said entrance is smaller than said inner perimeter at said exit.

11. A humidifier as defined in claim 9, further comprising a tapered sleeve located between said entrance and said exit of said contraction zone, said tapered sleeve having an inner surface which defines said outer perimeter.

12. A humidifier comprising:

a housing including an air inlet, an air outlet, a contraction zone and a reservoir for holding water;

a wick unit positioned within said housing to contact the water in said reservoir; and a fan having a propeller provided within said housing for creating an airflow having a mean velocity, said propeller being located within said contraction zone, the airflow entering said air inlet, passing through said wick unit for adding moisture to the airflow from the water in said reservoir, passing through said contraction zone for increasing the mean velocity of the airflow and exiting through said air outlet, wherein said contraction zone includes:

an entrance having a first-air-flow area to accommodate the airflow; and an exit having a second-air-flow area to accommodate the airflow, wherein said first-air-flow area is larger than said second-air-flow area, and wherein said first-air-flow area and said second-air-flow area are defined by an inner perimeter and an outer perimeter, wherein said outer perimeter at said entrance is larger than said outer perimeter at said exit, and wherein said humidifier further comprises a hub located between said entrance and said exit of said contraction zone, said hub including a substantially conical frustum shaped side surface which defines said inner perimeter.

13. A humidifier as defined in claim 12, wherein said propeller includes said hub and at least one fan blade.

14. A humidifier as defined in claim 7, further comprising a diffusion zone located between said contraction zone and said air outlet, said diffusion zone reducing the mean velocity of the airflow.

15. A humidifier as defined in claim 14, wherein said diffusion zone includes:

a first end having a third-air-flow area to accommodate the airflow; and a second end having a fourth-air-flow area to accommodate the airflow, wherein said third-air-flow area is smaller than said fourth-air-flow area.

16. A humidifier comprising:

a housing including an air inlet, an air outlet, a contraction zone and a reservoir for holding water;

a wick unit positioned within said housing to contact the water in said reservoir;

a fan having a propeller provided within said housing for creating an airflow having a mean velocity, said propeller being located within said contraction zone and defining a central axis of propeller rotation, said contraction zone being conically tapered with respect to said central axis, the airflow entering said air inlet, passing through said wick unit for adding moisture to the airflow from the water in said reservoir, passing through said contraction zone for increasing the mean velocity of the airflow and exiting through said air outlet; and a diffusion zone located between said contraction zone and said air outlet, said diffusion zone reducing the mean velocity of the airflow, said diffusion zone including a first end having a third-air-flow area to accommodate the airflow and a second end having a fourth-air-flow area to accommodate the airflow, wherein said third-air-flow area is smaller than said fourth-air-flow area, and wherein said third-air-flow area and said fourth-air-flow area are defined by a second inner perimeter and a second outer perimeter, wherein said second outer perimeter at said first end is smaller than said second outer perimeter at said second end.

17. A humidifier as defined in claim 16, wherein said second inner perimeter at said first end is substantially equal to said second inner perimeter at said second end.

18. A humidifier comprising:

a housing including an air inlet, an air outlet, a contraction zone and a reservoir for holding water;

a wick unit positioned within said housing to contact the water in said reservoir;

a fan having a propeller provided within said housing for creating an airflow having a mean velocity, said propeller being located within said contraction zone, the airflow entering said air inlet, passing through said wick unit for adding moisture to the airflow from the water in said reservoir, passing through said contraction zone for increasing the mean velocity of the airflow and exiting through said air outlet; and a diffusion zone located between said contraction zone and said air outlet, said diffusion zone reducing the mean velocity of the airflow, wherein said diffusion zone includes:

a first end having a third-air-flow area to accommodate the airflow; and a second end having a fourth-air-flow area to accommodate the airflow, wherein said third-air-flow area is smaller than said fourth-air-flow area, and wherein said third-air-flow area and said fourth-air-flow area are defined by a second inner perimeter and a second outer perimeter, wherein said second outer perimeter at said first end is smaller than said second outer perimeter at said second end, and wherein said humidifier further comprises a second tapered sleeve located between said first end and said second end of said diffusion zone, said second tapered sleeve having a second inner surface which defines said second outer perimeter.

19. A humidifier as defined in claim 16, further comprising a tube located between said first end and said second end of said diffusion zone, said tube including a substantially cylindrical shaped side surface which defines said second inner perimeter.

20. A humidifier as defined in claim 16, wherein said air outlet is formed as a grill at said second end of said diffusion zone and said tube is connected to said grill.

* * * * *